US006283470B1

(12) United States Patent
Hirai

(10) Patent No.: US 6,283,470 B1
(45) Date of Patent: Sep. 4, 2001

(54) SHEET TREATING APPARATUS WITH ALIGNING DEVICE AND IMAGE FORMING APPARATUS HAVING THE SAME

(75) Inventor: Katsuaki Hirai, Moriya-machi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/447,287

(22) Filed: Nov. 23, 1999

(30) Foreign Application Priority Data

Nov. 27, 1998 (JP) ..... 10-338237

(51) Int. Cl.[7] ..... B65H 29/40; B65H 31/32

(52) U.S. Cl. ..... 271/189; 271/163; 271/178; 271/218; 271/220

(58) Field of Search ..... 271/163, 178, 271/189, 218, 220, 314

(56) References Cited

U.S. PATENT DOCUMENTS

| | | | | |
|---|---|---|---|---|
| 4,883,265 | * | 11/1989 | Iida et al. | 271/220 |
| 5,249,793 | * | 10/1993 | Scheufler | 271/220 |
| 5,294,107 | * | 3/1994 | Allmendinger et al. | 271/220 |
| 5,473,420 | * | 12/1995 | Rizzolo et al. | 355/231 X |
| 5,478,061 | * | 12/1995 | Murakami et al. | 270/53 X |
| 5,573,233 | | 11/1996 | Hirai et al. | 270/58.08 |
| 5,671,917 | | 9/1997 | Choho et al. | 271/111 |
| 5,897,250 | | 4/1999 | Hirai et al. | 399/404 |

FOREIGN PATENT DOCUMENTS 2-215648 * 8/1990 (JP) .

* cited by examiner

*Primary Examiner*—Christopher P. Ellis
*Assistant Examiner*—Kenneth W Bower
(74) *Attorney, Agent, or Firm*—Fitzpatrick, Cella, Harper & Scinto

(57) ABSTRACT

A sheet treating apparatus capable of stacking discharged sheets in the shape of bundle, including a sheet stacking device so positioned that the downstream side in the discharging direction is higher than the upstream side and serving to stack the sheets, a sheet receiving member so provided as to project from the sheet stacking device and serving to receive the upstream end of the sheets on the sheet stacking device, a sheet advancing device for advancing the sheet onto the sheet stacking device, an elastic annular sheet trailing end aligning member rotatably provided in the vicinity of the sheet advancing device and serving to move the sheets stacked on the sheet stacking device toward the sheet receiving member, and a pivotally movable regulating member provided in a vertically pivotable manner in the vicinity of the sheet advancing device and provided with an inclined face adapted to descend after the sheets are discharged onto the sheet stacking device and to guide, in the descended state, the trailing end of the sheet in the floating state toward the sheet stacking device, wherein the leading end of the inclined face in the descended state of the pivotally movable regulating member protrudes externally from the external periphery of the sheet trailing end aligning member while the lower end is positioned lower than the center of the sheet trailing end aligning member when it is in a truly circular state and the lower end is in the vicinity of the external periphery of the sheet trailing end aligning member.

4 Claims, 33 Drawing Sheets

SHEET TREATING APPARATUS WITH ALIGNING DEVICE AND IMAGE FORMING APPARATUS HAVING THE SAME

BACKGROUND OF THE INVENTION

1. Field of the Invention

The present invention relates to a sheet treating apparatus capable of discharging sheets in the shape of a bundle, and an image forming apparatus equipped with such sheet treating apparatus.

2. Related Background Art

The conventional sheet treating apparatus 500, shown in FIG. 44 and capable of discharging sheets in the shape of a bundle, receives a sheet, on which an image is formed by an unrepresented image forming apparatus, by paired entrance rollers 2 and discharges the sheet by a large conveying roller 5 onto an intermediate tray 230, and, when plural sheets are stacked, the sheets are discharged as a bundle onto a tray 200 by rollers 180*a*, 180*b*. The roller 180*b* is elevated or lowered by a pivotally movable guide 150. When plural sheets are stacked on the intermediate tray 230, the sheets are pressed against a trailing end stopper 231 by a rotating elastic annular knurled belt 182, constituting a sheet trailing end aligning member, whereby the trailing end of the sheets is aligned.

The sheet may be composed of plain paper, a thin resinous sheet used as substitute for plain paper, a postcard, an envelope or a thin plastic plate.

Also the image forming apparatus can be a copying apparatus, a facsimile apparatus, a printer or a composite apparatus thereof.

However, when the sheet is discharged onto the intermediate tray 230 by discharge rollers 7, the trailing end of the sheet may be bent upwards in a curled state. In such case, the trailing end of the sheet comes into contact with the knurled belt 182, and is further bent upwards by the rotation of the discharge roller 7 whereby the sheet cannot be stacked on the intermediate tray 230 with alignment of the trailing end with other sheets, so that the alignment of the trailing end is unsatisfactory in such apparatus.

Also such upward bent sheet may be pinched between the knurled belt 182 and the intermediate tray 230, leading eventually to sheet jamming.

SUMMARY OF THE INVENTION

The object of the present invention is to provide a sheet treating apparatus capable of improving the alignment of the trailing end of the sheets and preventing sheet jamming, and an image forming apparatus provided with such sheet treating apparatus.

According to the present invention, there is provided a sheet treating apparatus capable of stacking sheets in the shape of a bundle, the apparatus comprising sheet stacking means so positioned in the main body that the trailing end of the sheet stacking means is lower than the leading end and serving to stack sheets on the sheet stacking means, a sheet receiving member projecting from the sheet stacking means and serving to receive the trailing end of the sheets on the sheet stacking means, sheet advancing means for advancing sheet onto the sheet stacking means, an elastic annular sheet trailing end aligning member rotatably disposed in the vicinity of the sheet advancing means and serving to move the sheets stacked on the sheet stacking means toward the sheet receiving member, and a pivotally movable regulating member provided in a vertically pivotable manner in the vicinity of the sheet advancing means, the pivotally movable regulating member descending after the sheets are discharged onto the sheet stacking means and having an inclined surface for guiding, in the descended state of the pivotally movable regulating member, the trailing end of the sheet in the floating state on the sheet stacking means toward the sheet stacking means, wherein the distal end of the inclined surface in the descended state of the pivotally movable regulating member protrudes externally from the external periphery of the sheet trailing end aligning member while the lower end is positioned lower than the center of the sheet trailing end aligning member when the sheet trailing end aligning member is in a truly circular state and the lower end is in the vicinity of the external periphery of the sheet trailing end aligning member.

The sheet, bearing the image formed thereon, is conveyed in the main body and is discharged by the sheet advancing means onto the sheet stacking means. Then the pivotally movable regulating member in the elevated state descends. The-sheet discharged onto the sheet stacking means slides on the inclined sheet stacking means and is received by the sheet receiving member, whereby the trailing end of the sheet is aligned.

In case the trailing end of the sheet discharged onto the sheet stacking means is significantly bent upwards, such trailing end comes into contact with the inclined surface of the pivotally movable regulating member in the course of sliding down on the sheet stacking means, whereby the bending of the sheet is corrected and the sheet is brought into contact with the sheet receiving member by the rotation of the sheet trailing end aligning member.

Since the lower end of the inclined surface of the pivotally movable regulating member is positioned lower than the center of the sheet trailing end aligning member, the trailing end, significantly bent upward, of the sheet does not come into contact with the external periphery of the sheet trailing end aligning member which is positioned higher than the center of the sheet trailing end aligning member, whereby the trailing end of the sheet securely enters between the sheet trailing end aligning member and the sheet stacking means.

The sheets after trailing end alignment are discharged as a bundle from the main body.

In the sheet treating apparatus of the present invention, the pivotally movable regulating member is so provided as to pivotally move to an upper position not interfering with the sheet when the sheet is advanced by the sheet advancing means.

In the sheet treating apparatus of the present invention, the pivotally movable regulating member is provided in each of plural positions in a direction crossing the sheet advancing direction, and at least one of such members is positioned outside the sheet trailing end aligning member.

As the pivotally movable regulating member is positioned outside the sheet trailing end aligning member, the sheet can be securely guided even if a corner portion of the trailing end of the sheet is curled.

The image forming apparatus of the present invention is provided with image forming means for forming an image on the sheet, and any one of the above-described sheet treating apparatuses.

In the sheet treating apparatus of the present invention, in case the trailing end of the sheet discharged onto the sheet stacking means is significantly bent upwards, the trailing end of the sheet comes into contact with the inclined surface of the pivotally movable regulating member in the middle of the sliding-down motion of the sheet on the sheet stacking means whereby the sheet bending is corrected and the trailing end is brought into contact with the sheet receiving member by the rotation of the sheet trailing end aligning member. It is therefore rendered possible to improve the alignment of the sheet trailing end and to prevent the sheet from being pinched between the sheet trailing end aligning member and the sheet stacking means thereby avoiding the sheet jamming.

Also when the sheet is advanced by the sheet advancing means, the pivotally movable regulating member pivots upwards to avoid interference with the sheet, whereby the sheet can be smoothly discharged onto the sheet stacking means.

Also, as the pivotally movable regulating member is positioned outside the sheet trailing end aligning member, the sheet can be securely guided even if the corner portion of the trailing end of the sheet is curled.

The image forming apparatus of the present invention, being provided with the above-described sheet treating apparatus capable of discharging the sheets in the shape of a bundle without sheet jamming or damage to the sheet, can provide the user with sheets of satisfactory quality.

DESCRIPTION OF THE PREFERRED EMBODIMENTS

Figure 43:
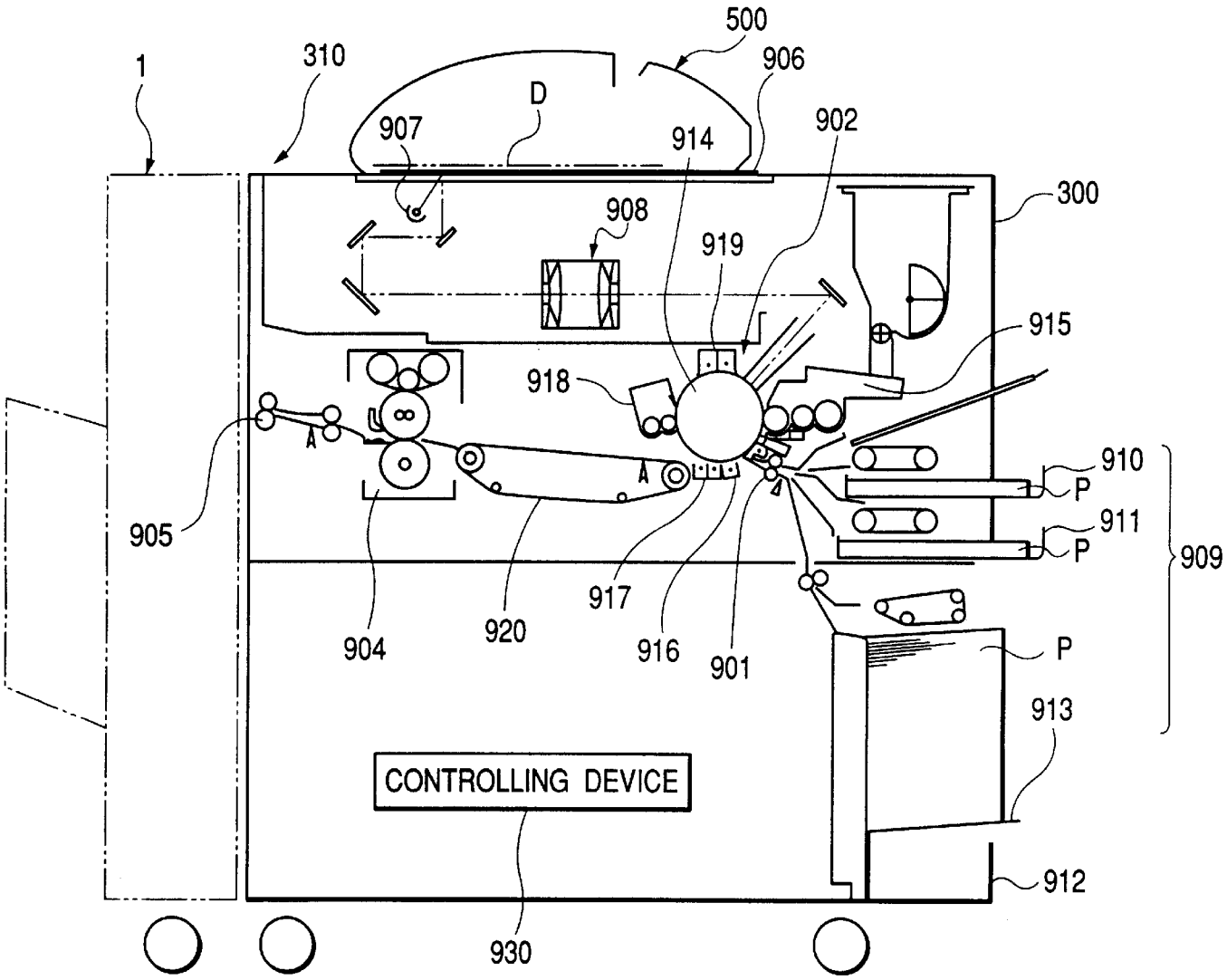
FIG. 43 is an elevation view of an image forming apparatus in which the sheet treating apparatus of the present invention is applicable.
Figure 44:
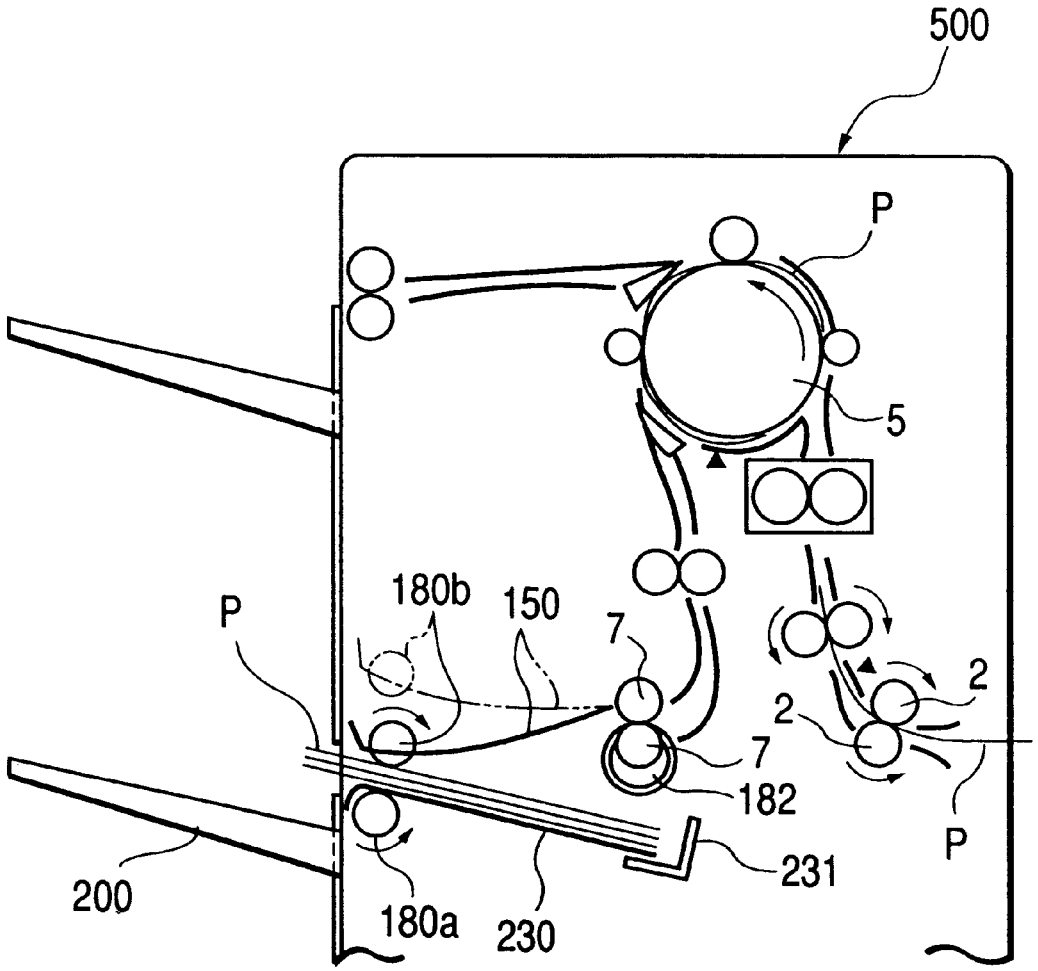
FIG. 44 is a schematic cross-sectional front view of a conventional sheet treating apparatus.

FIG. 43 shows an example of an image forming apparatus (copying machine) 310 in which a sheet treating apparatus 1 of the present invention is provided in a main body 300 of the image forming apparatus (main body of the copying machine).

The main body 300 of the image forming apparatus (copying machine) is provided with a platen glass 906 serving as an original stocking plate; a light source 907; a lens system 908; a sheet feeding portion 909; an image forming portion (image forming means) 902; an auto original feeder (recycling document feeder (RDF)) 500 for feeding the original to the platen glass 906; and a sheet treating apparatus 1 of the embodiment of the present invention, for stacking the sheet, discharged from the main body 300 and bearing images thereon.

The sheet treating apparatus 1 of the embodiment of the present invention may be incorporated not only in the main body of the copying machine but also in that of a facsimile apparatus, a printer or a composite apparatus thereof. Consequently, the image forming apparatus used herein includes not only the main body of the copying machine but also the facsimile apparatus, the printer and the composite apparatus thereof.

Also the sheet includes plain paper, thin resinous sheet used as a substitute for the plain paper, postcard, cardboard, envelope, thin plastic sheet etc.

The sheet feeding portion 909 is provided with cassettes 910, 911 containing recording sheets P and detachably mounted on the main body 300 of the apparatus, and a deck 913 provided on a pedestal 912. The image forming portion 902 is provided with a cylindrical photosensitive drum 914, and a developing device 915, a transfer charger 916, a separation charger 917, a cleaner 918 and a primary charger 919 provided around the photosensitive drum 914. At the downstream side of the image forming portion 902, there are provided a conveying device 920, a fixing device 904 and a pair of discharge rollers 905.

The details of the auto original feeder (RDF) 500 will be omitted.

In the following there will be explained the operation of the main body 300 of the image forming apparatus.

In response to a sheet feed signal supplied from a controlling device 930 of the main body 300, a sheet P is fed from the cassette 910, 911 or the deck 913. On the other hand, the original D placed on the original stocking plate 906 is illuminated by the light from the light source 907, and the reflected light irradiates the photosensitive drum 914 through the lens system 908. The photosensitive drum 914 is in advance charged by the primary charger 919 and forms an electrostatic latent image thereon by the exposure to light, and the electrostatic latent image is developed by the developing device 915 to form a toner image.

The sheet P fed from the sheet feeding portion 909 is subjected to correction of skew feed by the registration rollers 901, and is fed to the image forming portion 902 in a registered timing. In the image forming portion 902, the toner image on the photosensitive drum 914 is transferred onto the fed sheet P by the transfer charger 916, and the sheet P bearing the transferred toner image is charged by the separation charger 917 in a polarity opposite to that of the transfer charger 916 and is thus separated from the photosensitive drum 914.

Thus separated sheet P is conveyed by the conveying device 920 to the fixing device 904, in which the transferred image is permanently fixed to the sheet P. The sheet P bearing the fixed image is discharged by the pair of discharge rollers 905 from the main body 300 of the apparatus.

In this manner, the sheet P fed from the sheet feeding portion 909 is subjected to image formation and is discharged to the sheet treating apparatus 1 of the present invention.

In the following there will be explained the sheet treating apparatus of the embodiment of the present invention.

Figure 1:
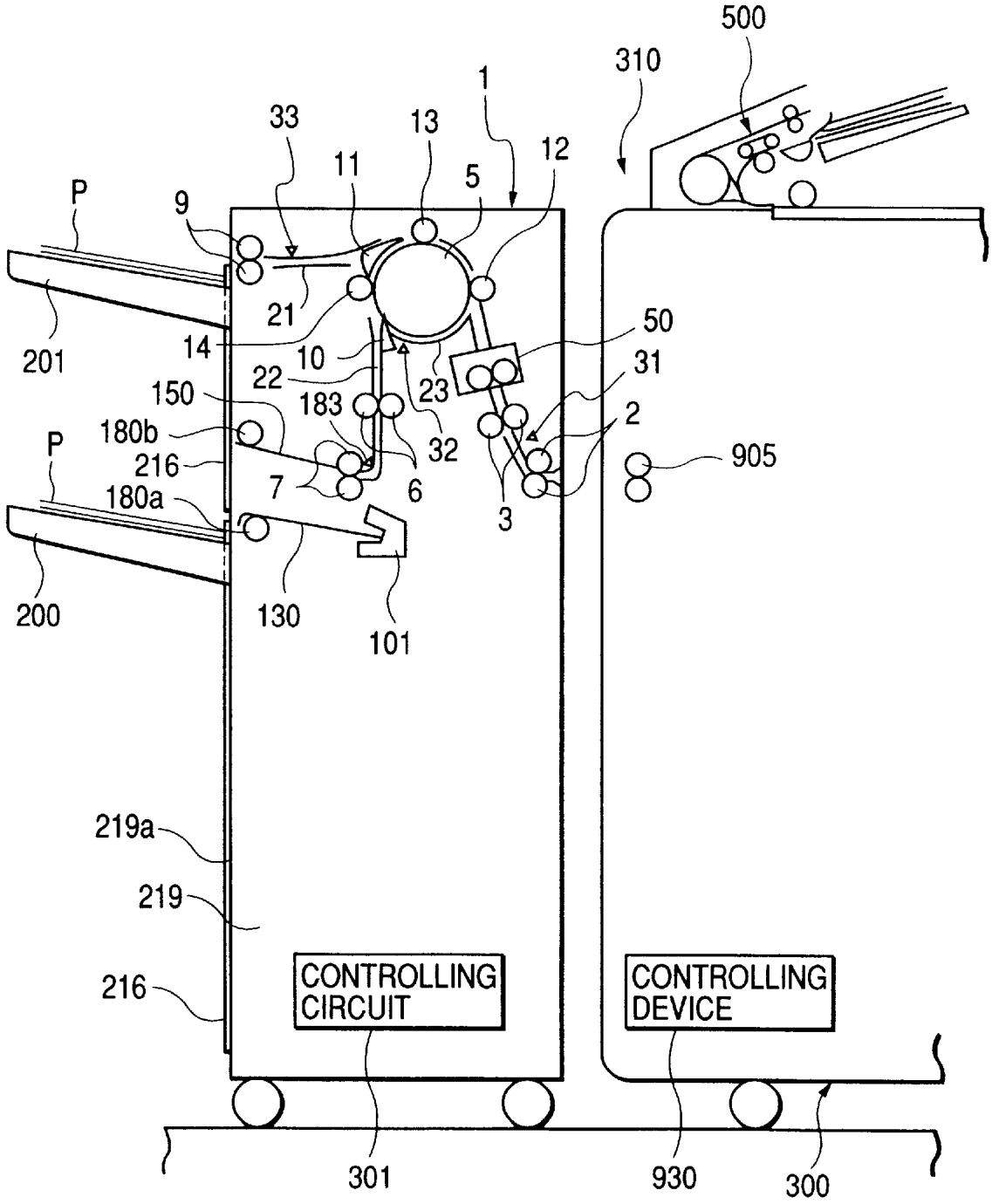
FIG. 1 is a schematic front cross-sectional view showing an entire configuration of a sheet treating apparatus of the present invention.

Referring to FIG. 1, the finisher (sheet treating apparatus) 1 is equipped in the main body 300 of the image forming apparatus.

In FIG. 1, there are shown paired discharge rollers 905 of the main body 300 of the image forming apparatus; paired entrance rollers 2 of the finisher 1; paired conveying rollers 3; a sheet sensor 31; a punch unit 50 for punching holes in the vicinity of the trailing end of the conveyed sheet; a large conveying roller 5; and depressing rollers 12, 13, 14 adapted to be depressed for conveying the sheet.

A change-over flapper 11 executes switching between a non-sort path 21 and a sort path 22. A change-over flapper 10 executes switching between the sort path 22 and a buffer path 23 for temporarily storing the sheets. There are also provided conveying rollers 6. Temporary stacking, alignment and stapling of the sheets can be executed on an intermediate tray (hereinafter referred to as "treating tray") 130.

Discharge rollers 7 serve to discharge the sheet onto the treating tray 130. A bundle discharge roller 180*b* is supported by the pivotally movable guide 150, and, when it moves to a closed position, the bundle discharge roller 180*b* cooperates with a roller 180*a* provided on the treating tray 130 to discharge the bundle of sheets on the treating tray 130 onto a stacking tray 200.

In the following there will be explained the stapling unit 100 with reference to FIGS. 2, 3 and 4.

Figure 2:
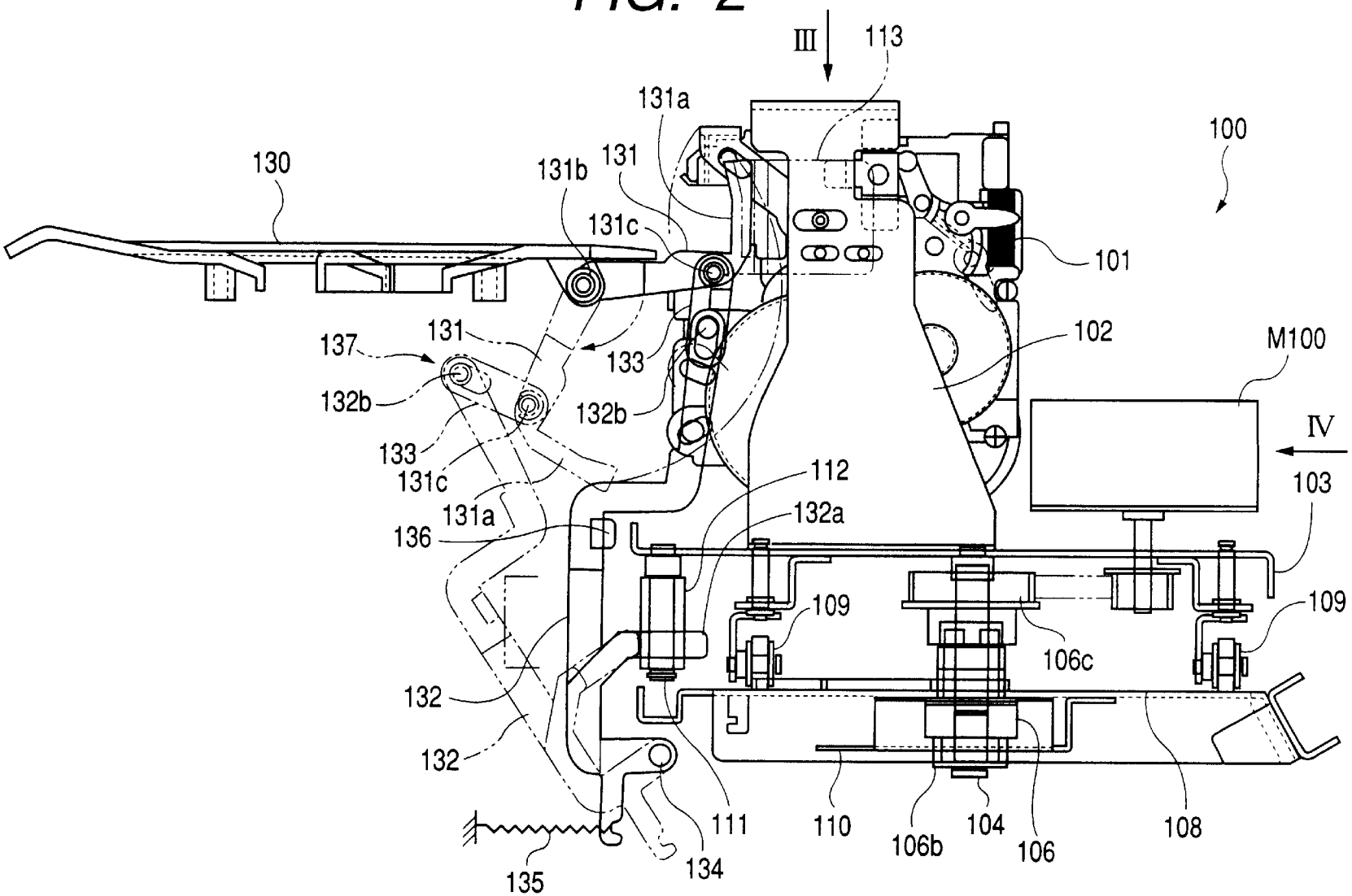
FIG. 2 is a side view of a stapler and a treating tray unit.
Figure 3:
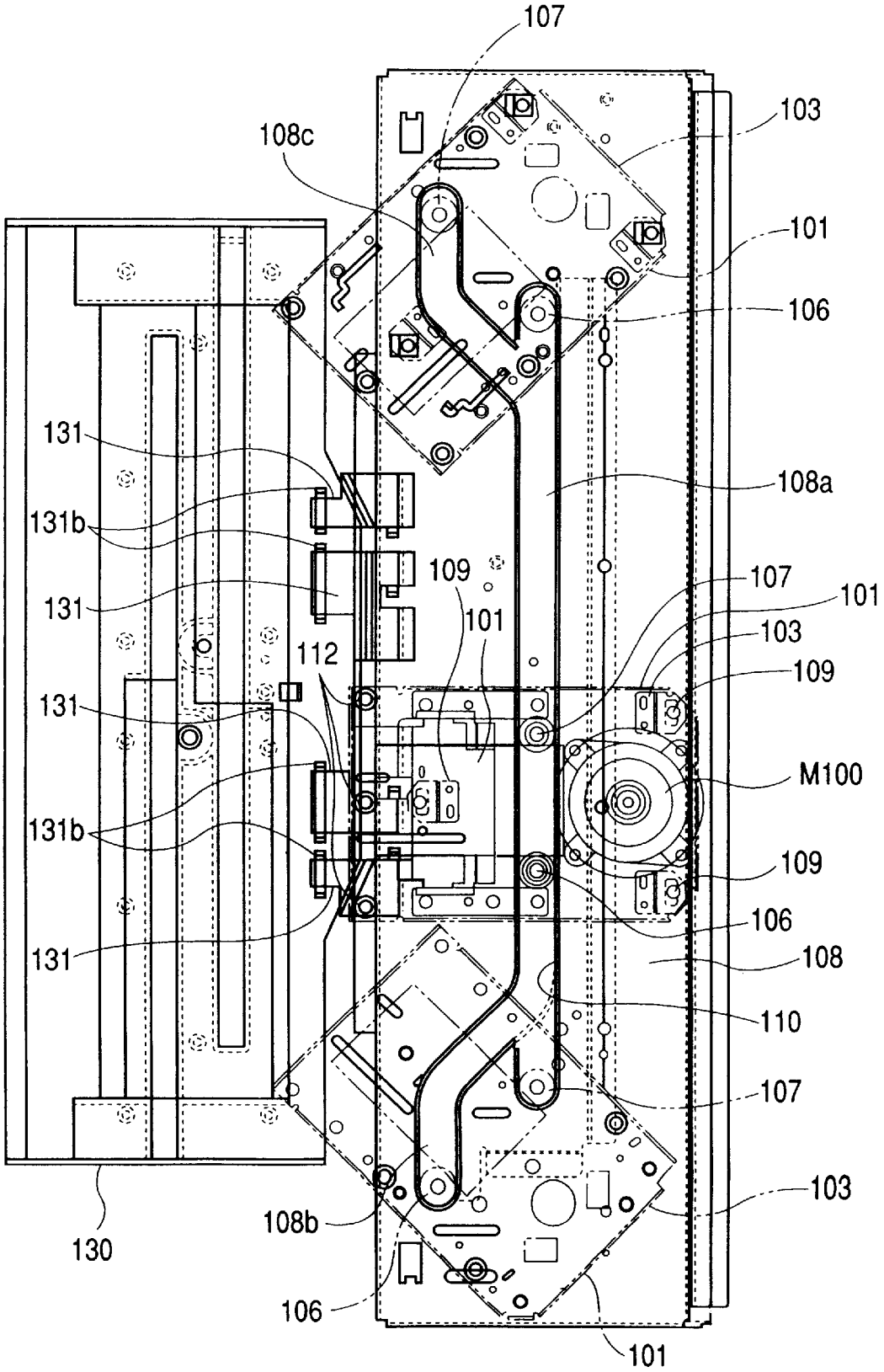
FIG. 3 is a plan view of a stapler moving mechanism looking in a direction indicated by arrow III in FIG. 2.
Figure 4:
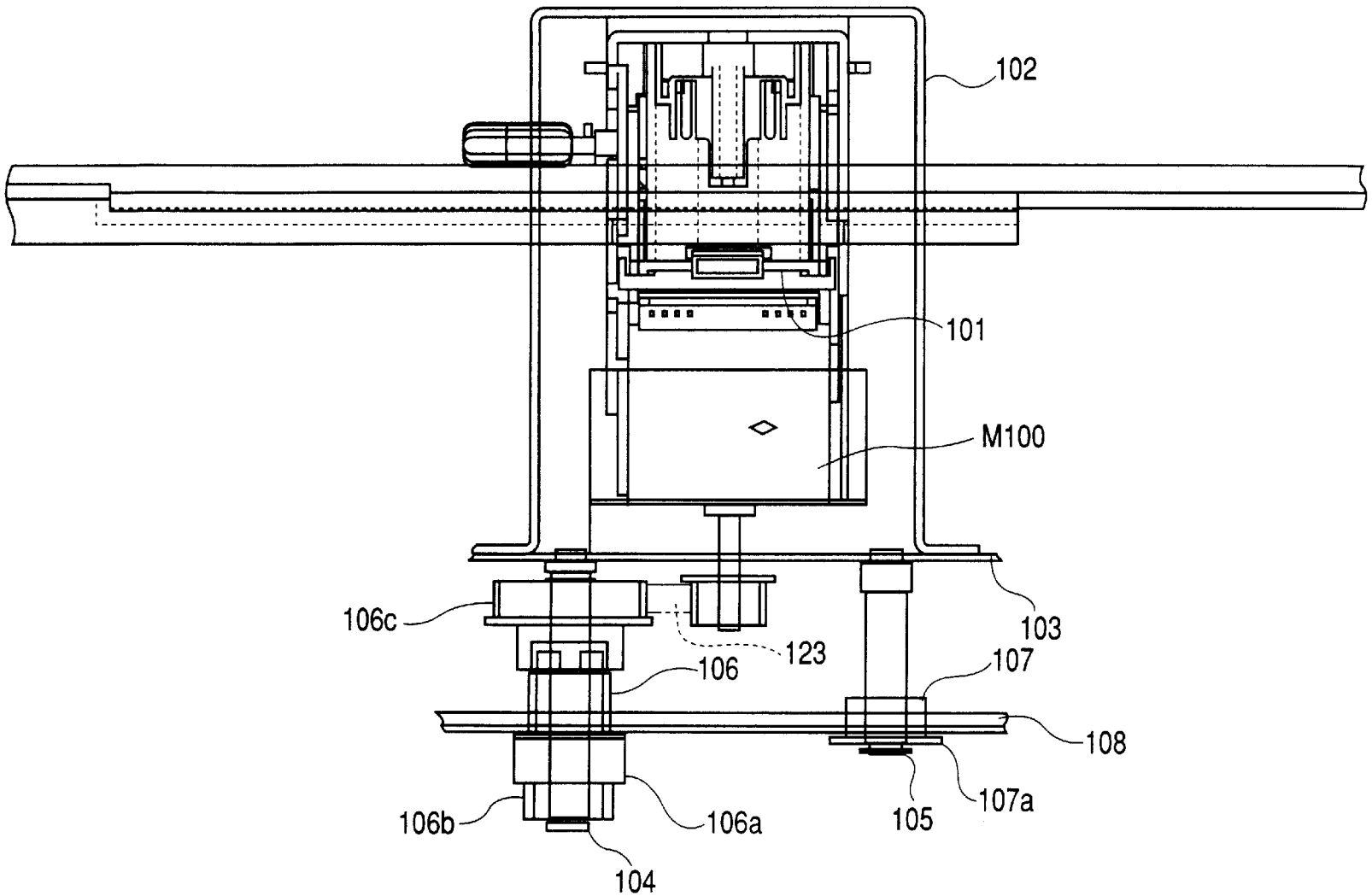
FIG. 4 is a rear view of the stapler looking in a direction indicated by arrow IV in FIG. 2.

FIG. 2 is an elevation cross-sectional view of the stapling unit 100, FIG. 3 is a view looking in a direction indicated by arrow III in FIG. 2, and FIG. 4 is a view looking in a direction indicated by arrow IV in FIG. 2.

A stapler 101 is fixed to a movable table 103 through a holder 102. Shafts 104, 105 (FIG. 4) fixed to the movable table 103 respectively rotatably support rollers 106, 107 which fit into aperture-shaped rails 108*a*, 108*b*, 108*c* (FIG. 3) formed in a fixed table 108.

The rollers 106, 107 are respectively provided with flanges 106*a*, 107*a* larger than the aperture-shaped rails 108*a*, 108*b*, 108*c* of the fixed table 108. Under the movable table 103, supporting rollers are provided in three positions. The movable table 103, supporting the stapler 101, can move on the fixed table 108 along the rails 108*a*, 108*b*, 108*c* without coming away from the fixed table 108. The movable table 103 can move, by rollers 109 rotatably provided thereon, on the fixed table 108.

The aperture-shaped rails 108*a*, 108*b*, 108*c* mentioned above branch in the front and rear parts to constitute two parallel rails. When the stapler 101 is positioned in front, based on the shape of these rails, the roller 106 fits in the rail portion 108*b* while the roller 107 fits in the rail portion 108*a* whereby the stapler 101 is inclined, corresponding to a corner of the sheet. When the stapler 101 is positioned at the central position, both rollers 106, 107 engage with the rail portion 108*a* whereby the stapler 101 is positioned parallel to the edge of the sheet.

When the stapler 101 is positioned at rear, the roller 106 fits in the rail portion 108*a* while the roller 107 fits in the rail portion 108*c* whereby the stapler 101 is inclined in a direction opposite to that when the stapler 101 is positioned in front, thereby being positioned corresponding to another corner of the sheet.

After the two rollers 106, 107 respectively fit into the parallel two rails, the stapler moves while maintaining its attitude, and the change in the direction is started by an unrepresented cam.

In the following there will be explained a moving mechanism for the stapler 101.

A pinion 106*b* of the roller 106 of the aforementioned movable table 103 is integrally constructed with a belt pulley 106*c*. The pinion 106*b* is connected, by a belt 123 supported by the pulley 106*c*, to a motor M100 which is fixed to the movable table 103 from above. On the other hand, on the lower surface of the fixed table 108, there is fixed a rack 110 along the aperture-shaped rail so as to mesh with the pinion 106*b*, whereby the movable table 103 moves forward and backward together with the stapler 101, by the forward and reverse rotation of the motor M100.

A shaft 111, extending downwards from the movable table 103, supports a stopper turn-down roller 112, which, as will be explained in more details, serves to rotate a trailing end stopper 131 of the treating tray 130 in order to prevent the stapler 101 from colliding against the trailing end stopper 131.

The stapler unit 100 is provided with a sensor for detecting a home position of the stapler 101, and the stapler 101 normally waits in the home position (frontmost position in the present embodiment).

In the following there will be explained, with reference to FIGS. 2 and 3, the trailing end stopper 131 for receiving the trailing end of the sheets P stacked on the treating tray 130.

The trailing end stopper 131 has a surface perpendicular to the stacking surface of the treating tray 130, and is provided with a supporting surface 131*a* for receiving the trailing end of the sheet, a pin 131*b* fitted in a circular hole provided in the treating tray 130 and constituting a center of pivotal movement of the trailing end stopper 131, and a pin 131*c* connected to a link mechanism 137 to be explained later. The link mechanism 137 is constituted by a main link member 132 having a cam surface 132*a* to be brought into contact with and pressed by the roller 112 mounted on the movable table 103 of the stapler, and a connecting link member 133 connecting a pin 132*b* provided on the upper end of the main link member 132 and the pin 131*c* of the trailing end stopper 131.

The main link member 132 is adapted to execute pivotal movement about a shaft 134 fixed on an unrepresented frame. The main link member 132 is provided, at the lower end thereof, with a extension spring 135 for clockwise biasing the main link member 132, and is positioned by an abutting plate 136. Therefore, the trailing end stopper 131 normally maintains its attitude perpendicular to the treating tray.

When the movable table 103 of the stapler moves, the turn-down roller 112 provided thereon presses down the cam surface 132*a* of the main link member 132, connected to the trailing end stopper 131 which is in interference with the stapler 101, whereby the trailing end stopper 131 is pulled by the connecting link member 133 and is rotated to a position not in interference with the stapler 101. A plurality of the turn-down rollers 112 are provided (three in the present embodiment shown in FIG. 3), in order that the trailing end stopper 131 maintains the retracted position during the movement of the stapler 101.

On both sides of the holder 102 supporting the stapler 101, there are provided staple stoppers 113 (represented by an alternate long and two short dashes line in FIG. 2) having a supporting surface in the same shape as the trailing end stopper 131. The staple stoppers 113 serve to receive the trailing end of the sheets, instead of the trailing end stopper 131, when the trailing end stopper 131 is pressed down by the stapler 101 positioned at the central position in FIG. 3 and becomes incapable of receiving the trailing end of the sheets.

In the following there will be explained a treating tray unit 129 with reference to FIGS. 5 to 10.

The treating tray unit 129 is positioned between the conveying portion for conveying the sheet from the main body 300 of the image forming apparatus and the stack tray 200 for receiving and supporting the bundle of sheets handled on the treating tray 130.

In the sort path 22 in the vicinity of the paired discharge rollers 7, 7 of the conveying portion, a sensor 183 is provided for detecting the sheet moving in the sort path 22. The sensor 183 is connected to a controlling circuit 301 of the sheet treating apparatus 1. The controlling circuit 301 is connected to the controlling device 930 in the main body of the copying machine, in order to control not only the operation of the sheet treating apparatus but also the smooth cooperative operation with the main body of the copying machine.

Also based on the sheet detection signal generated by the sensor 183 each time the sensor 183 detects the sheet, the controlling circuit 301 counts the number of sheets and controls motors M141, M142 for rotating pinions 143, 144 to be explained later according to the counted number of sheets, thereby moving a front-side aligning mechanism 141 and an aligning member 142.

In the vicinity of the downstream end of the sort path 22 where the paired discharge rollers 7, 7 of the conveying portion are provided, there are provided a trailing end dropping member 181 and a knurled belt 182.

Figure 6:
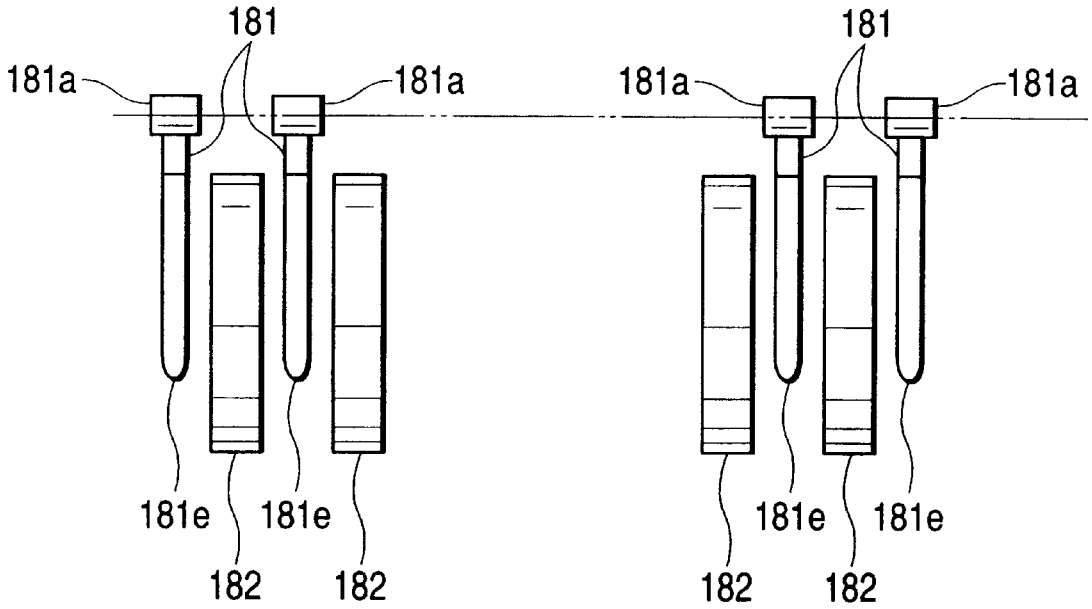
FIG. 6 is a plan view showing an arrangement of a trailing end dropping member and a knurled belt.

As shown in FIG. 6, four trailing end dropping member 181 and four knurled belt 182 are provided along a direction crossing the sheet conveying direction. In this case, the trailing end dropping member 181 at each end is positioned outside the knurled belt 182.

The trailing end dropping member 181 is pivotally movable in the vertical direction about a shaft 181*a* constituting the center of the pivotal movement. It normally waits in the solid-lined position by being received by the stopper 181*b*, and, when a sheet is discharged by the paired discharge rollers 7, 7, it is elevated to a broken-lined position by a plunger PL181 so as not to hinder the discharge of the sheet from the paired rollers 7, 7.

The knurled belt 182 is composed of an annular elastic member (made of rubber or plastics) having knurls on the external periphery thereof, and is pinched between unrepresented rotary shafts of the paired discharge rollers 7, 7 thereby being rotated in a direction indicated by an arrow.

The lowermost end 181*c* of the trailing end dropping member 181 is positioned lower than the center 182*a* of the knurled belt 182 when the knurled belt 182 is in a truly circular state and within the area of the knurled belt 182. Therefore, a sheet guiding surface 181*d* of the trailing end dropping member 181 is positioned close to the tangential line to the knurled belt 182 and a distal end 181*e* of the trailing end dropping member 181 protrudes from the external periphery of the knurled belt 182.

The treating tray unit 129 is composed of a treating tray 130, a trailing end stopper 131, an aligning device 140, a pivotally movable guide 150, a pull-in paddle 160, a retractable tray 170, and paired bundle discharge rollers 180*a*, 180*b*, and so on.

The treating tray 130 is so inclined that the downstream side (left side in the drawing) is higher and the upstream side (right side in the drawing) is lower, and the aforementioned trailing end stopper 131 is fitted on the lower end.

A lower bundle discharge roller 180*a* is provided at the upper end of the treating tray 130, while an upper bundle discharge roller 180*b* engageable with the roller 180*a* is provided on the pivotally movable guide 150 to be explained later, and these rollers 180*a*, 180*b* are rotated in the forward and reverse direction by a motor M180.

In the following there will be explained an operation of the trailing end dropping member 181, and an operation of the treating tray unit 129 will be explained later.

Figure 5:
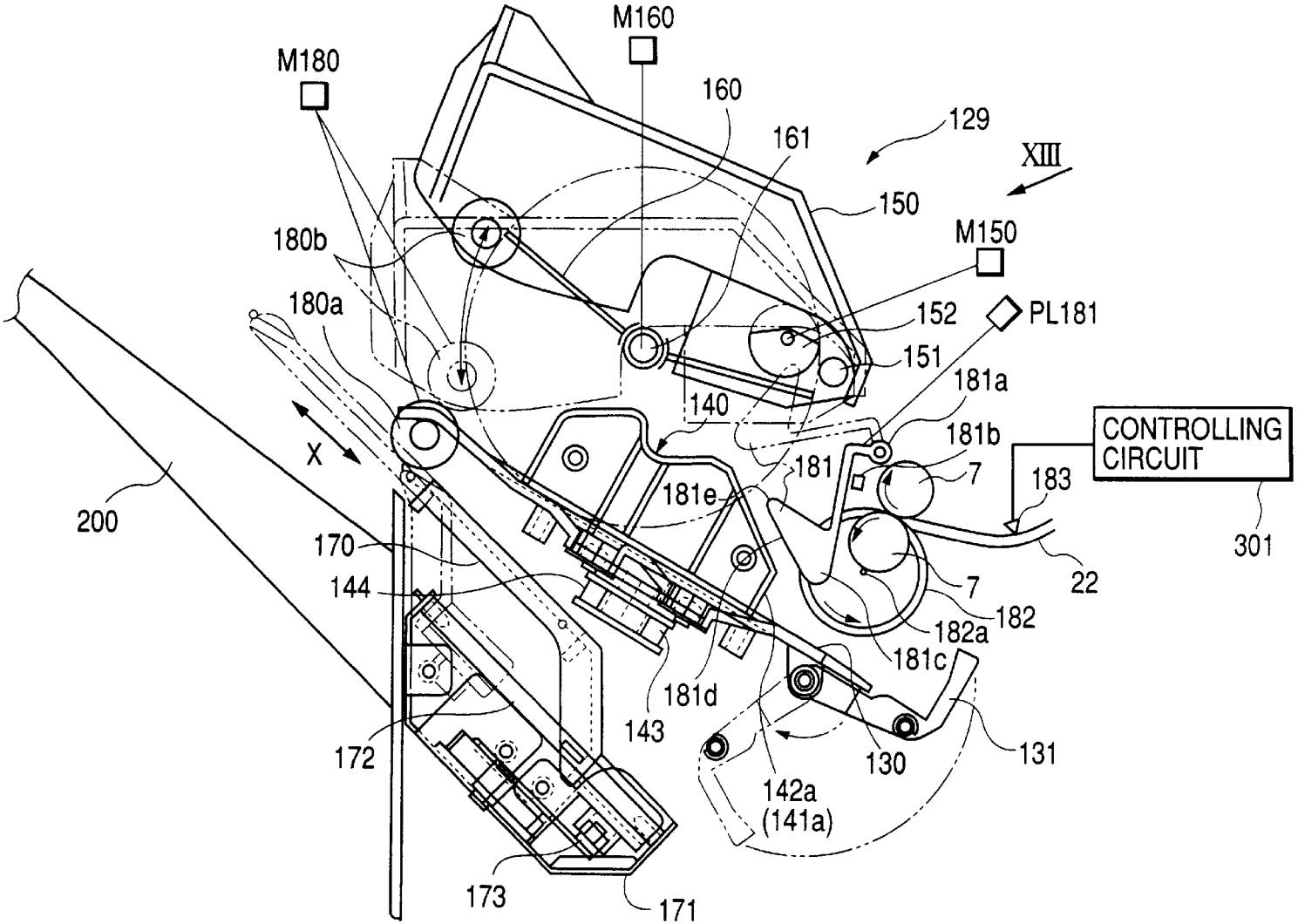
FIG. 5 is a vertical cross-sectional side view of a pivotally movable guide and a treating tray.
Figure 9:
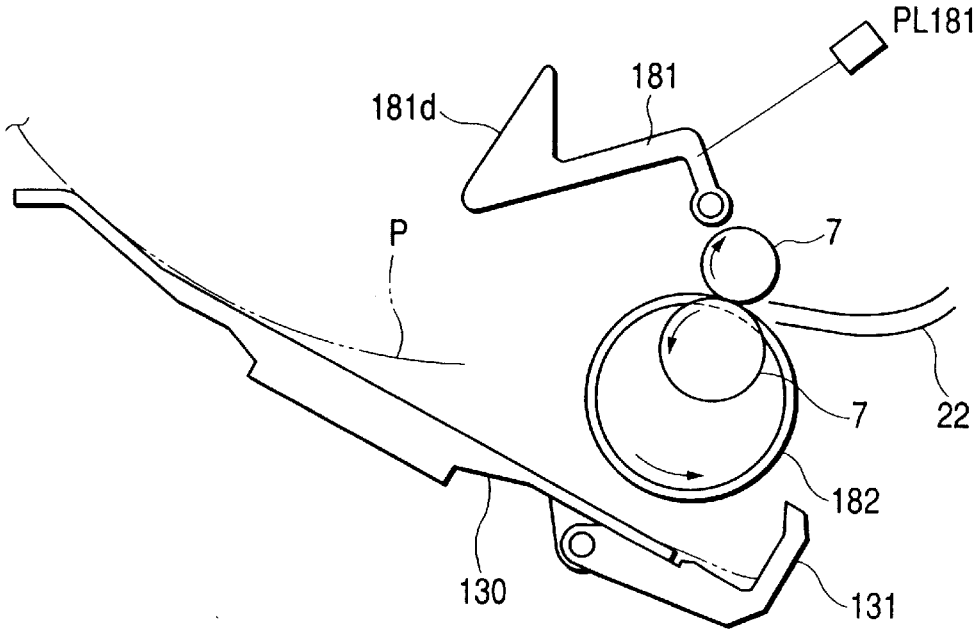
FIGS. 9 and 10 are views illustrating an operation of the trailing end dropping member in FIG. 5.
Figure 10:
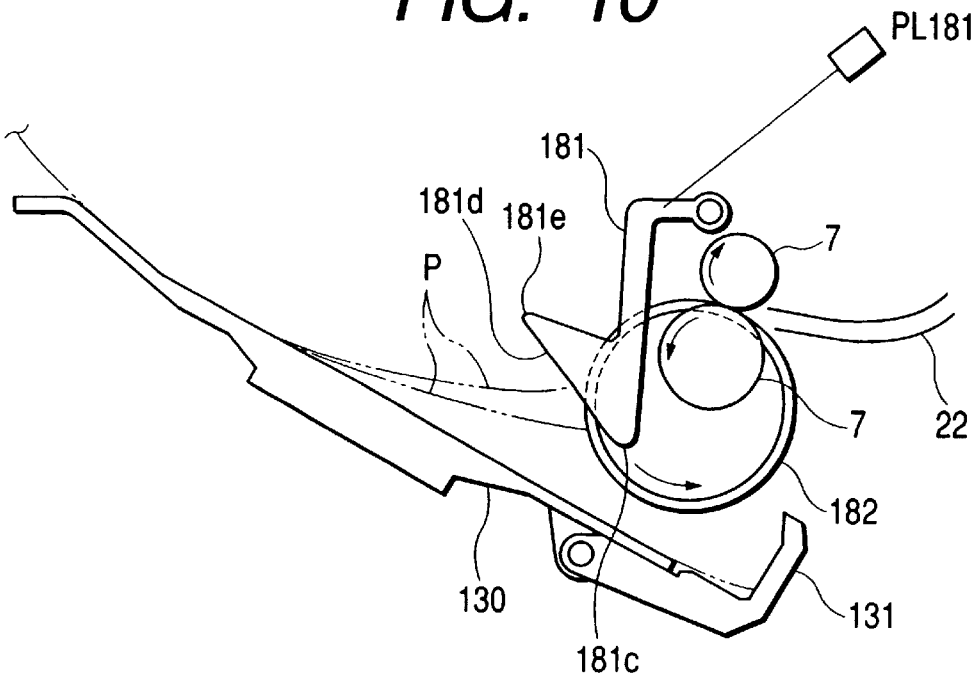

Referring to FIGS. 5 and 9, a sheet P is ejected by the paired discharge rollers 7, 7 of the conveying portion onto the treating tray 130 while the trailing end dropping member 181 is elevated to the broken-lined position. After the discharge of the sheet P, the trailing end dropping member 181 is lowered (FIGS. 5, 10). The discharged sheet P slides on the treating tray 130 by its weight and by the function of the paddle 160 to be explained later until the trailing end of the sheet P abuts against the trailing end stopper 131.

In this operation, even if the trailing end of the sheet P is bent (curled) upwards and floats from the treating tray 130, it is guided to the trailing end stopper 131 by the guiding function of the inclined sheet guiding surface 181*d* of the trailing end dropping member 181 in the lowered state and the rotary guiding function of the knurled belt 182. Also in case the sheet curling is large, the trailing end dropping member 181 in the course of descent to the solid-lined position presses the trailing end of the sheet from above, thereby correcting the curling.

It is therefore possible to prevent a phenomenon that the trailing end of the sheet comes into contact with the trailing end dropping member 181 and is curled more in the sliding motion of the sheet, thereby eventually folded back and is jammed between the trailing end dropping member 181 and the treating tray 130, and to securely stack the sheets on the treating tray 130.

Figure 7:
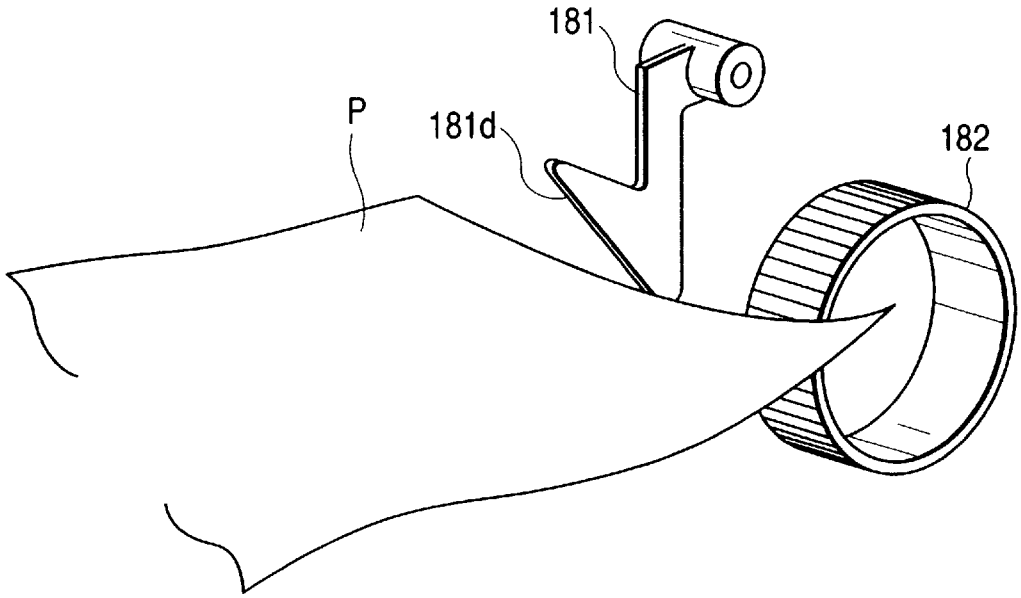
FIG. 7 is a view illustrating an operation when the trailing end dropping member is positioned inside an arrangement of the knurled belt.
Figure 8:
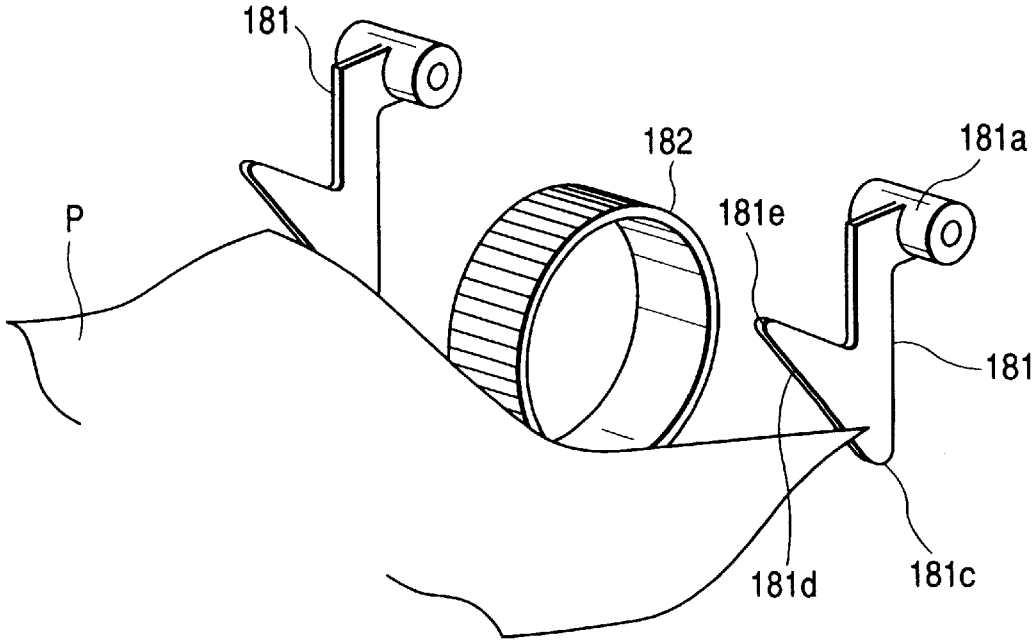
FIG. 8 is a view illustrating an operation when the trailing end dropping member is positioned outside an arrangement of the knurled belt.

Also, since the trailing end dropping members 181 on both sides are positioned outside the knurled belts 182, even if the end portions of the sheet, positioned outside such trailing end dropping members 181, are curled, such curled portions can be securely guided as shown in FIG. 8. Such curled portions of the sheet may not be securely guided if the trailing end dropping members 181 are not positioned outside the knurled belts 182 as shown in FIG. 7.

In the following there will be explained the upper and lower sides of the aligning device 140 with reference to FIGS. 11 and 12.

The front-side aligning mechanism 141 and the rear-side aligning member 142, constituting the aligning device 140, are rendered independently movable forward and backward.

The front-side aligning mechanism 141 is provided with a movable plate 145; a front-side aligning member 146; guide shafts 147, 147 protruded from the front-side aligning member 146 and penetrating through the movable plate 145; compression coil springs 148, 148 loosely fitted on the guide shafts 147 between the movable plate 145 and the front-side aligning member 146 and biasing the front-side aligning member 146 in a direction apart from the movable plate 145; stoppers 149 provided on the guide shafts 147 in order to avoid escaping of the guide shafts 147 from the movable plate 145; a rack 141*b* provided on the movable plate 145 and extending in a direction from the front-side to the rear-side; and three rollers 141*d* provided on the movable plate 145 and the rack 141*b* and movable in a guide hole 130*a* formed in the treating tray 130. The edges of the guide hole 130*a* are recessed so that the rollers 141*d* are not in contact with the lower surface of the sheet.

The front-side aligning member 146 of the front-side aligning mechanism 141 and the rear-side aligning member 142 are respectively provided with aligning surfaces 146*a*, 142*a* upstanding on the treating tray 130 and pressing the side edges of the sheets, and supporting surfaces 146*c*, 142*c* perpendicularly connected to the aligning surfaces 146*a*, 142*a* and supporting the lower surface of the sheets P.

The rear-side aligning member 142 is provided with a rack 142*b* extending in a direction from the front-side to the rear-side. The rear-side aligning member 142 and the rack 142*b* are provided with three rollers 142*d* movable in a guide hole 130*b* formed in the treating tray 130. The edges of the guide hole 130*b* are recessed so that the rollers 142*d* are not in contact with the lower surface of the sheet.

The front-side aligning member 141 and the aligning member 142 are respectively supported by an open guide 140 extending in a direction from the front-side to the rear-side of the treating tray 130 and are so assembled that the aligning surfaces 146*a*, 142*a* are positioned on the upper surface of the treating tray 130 while the racks 141*b*, 142*b* are positioned on the lower surface of the treating tray 130.

The racks 141*b*, 142*b* respectively engage with pinions 143, 144 which are respectively connected to motors M141, M142 through pulleys and belts. The front-side aligning mechanism 141 and the aligning member 142 are moved forward and backward by the forward and reverse rotation of the motors.

The front-side aligning mechanism 141 and the aligning member 142 are provided with sensors (not shown) for detecting the home positions, and normally wait in the home positions.

The aligning member 142 at the rear-side may be formed into the same structure as the front-side aligning mechanism.

It is also possible to form the front-side aligning mechanism into the same structure as the rear-side aligning member and to form the rear-side aligning member into the same structure as the front-side aligning mechanism.

Stated differently, at least one of the members for laterally aligning the sheets has to be formed into the same structure as the front-side aligning mechanism 141.

In the present embodiment, the front-side aligning mechanism 141 has its home position at the forehand position and the rear-side aligning member 142 has its home position at the backmost position.

In the following there will be explained the pivotally movable guide 150 (FIG. 5) of the treating tray unit 129.

The pivotally movable guide 150 is provided at the upstream side (right side in the drawing) with a pivot shaft 151, and, at the downstream side (left side) with the upper bundle discharge roller 180*b*. The pivotally movable guide 150 is in an open state (the bundle discharge rollers 180*a*, 180*b* are not in contact with each other) when the sheets P are discharged one by one onto the treating tray 130, thereby not hindering the sheet discharge and dropping onto the treating tray 130 or the aligning operation, but assumes a closed state (the bundle discharge rollers in mutual contact) when the sheet bundle is discharged from the treating tray 130 onto the stack tray 200.

A rotary cam 152 (FIG. 5) is provided in a position corresponding to the lateral side of the pivotally movable guide 150. The pivotally movable guide 150 assumes the open state by pivotally moving about the shaft 151 when the rotary cam 152 is rotated and pushes up the lateral side of the guide 150, and assumes the closed state when the rotary cam 152 rotates through 1800 from this state and leaves from the lateral side of the guide 150. The rotary cam 152 is rotated by a motor M150 which is connected through an unrepresented driving system to the rotary cam 152.

The closed state of the pivotally movable guide 150 is taken as its home position, and a sensor for detecting the home position is provided (not shown).

In the following there will be explained the pull-in paddle 160 (FIG. 5) of the treating tray unit 129.

The pull-in paddle 160 is fixed to a shaft 161, a which is rotatably supported by lateral plates on both sides. The paddle shaft 161 is connected to a motor M160 and is rotated counterclockwise when driven by the motor M160.

The length of the paddle 160 is selected somewhat longer than the distance to the treating tray 130. The home position of the paddle 160 is selected at a position (solid-line position in the drawing) not coming into contact with the sheet P discharged by the discharge rollers 180*a*, 180*b* onto the treating tray 130. When the sheet P is discharged in this state and falls on the treating tray 130, the paddle is rotated counterclockwise by the motor M160, thereby pulling in the sheet P until the sheet P comes into contact with the trailing end stopper 131. After the lapse of a predetermined time thereafter, the paddle 160 stops at the home position, thereby preparing for the next sheet discharge.

Figure 13:
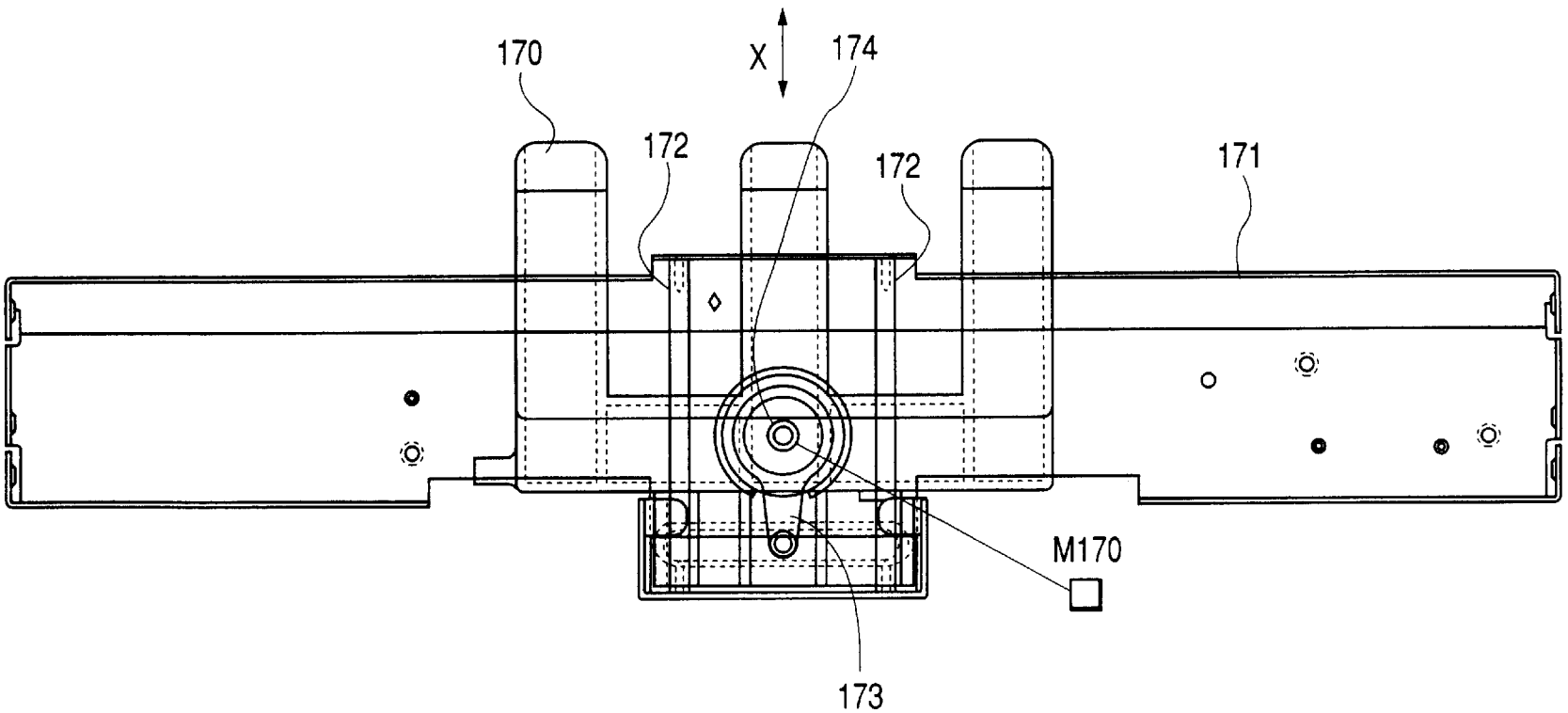
FIG. 13 is a rear view of a retractable tray.

In the following there will be explained the retractable tray 170 with reference to FIG. 13, looking in a direction indicated by arrow XIII in FIG. 5.

The retractable tray 170 is positioned under the lower bundle discharge roller 180*a* and can be extended and retracted in the sheet conveying direction (direction indicated by double-headed arrow X in FIGS. 5 and 13), substantially along the inclination of the treating tray 130. The retractable tray 170, in the extended state, has the distal end overlapping the stack tray 200 (the alternate long and two short dashes line in FIG. 5), and, in the retracted state, has the distal end retracted to the right-hand side from the bundle discharge rollers. The distal end position in the extended state is so selected as not to be exceeded by the center of gravity of the sheet P discharged onto the treating tray 130.

The retractable tray 170 is supported by rails 172 fixed to a frame 171, and is rendered movable in the sheet discharging direction. A rotary link member 173 rotates about a shaft 174 and engages with a groove formed on the lower surface of the retractable tray 170. Therefore the retractable tray 170 is extended and retracted as explained above, through one revolution of the rotary link member 173.

The rotary link member 173 is rotated by a motor M170 through an unrepresented drive mechanism. The home position of the retractable tray 170 is selected at the retracted position (solid-lined position), and is detected by an unrepresented sensor.

In the following there will be explained a stack tray 200 and a sample tray 201 with reference to FIGS. 14 and 15.

These two trays 200, 201 are selected according to the situation. The stack tray 200 in the lower position is selected in case of receiving the copied or printed sheet. The sample tray 201 in the upper position is selected in case of receiving a sample sheet, an interruption processed sheet, a sheet in case of overflow of the stack tray, a sheet by function sorting, or a sheet in job mixed loading.

These two trays 200, 201 are respectively provided with motors 202 so as to be independently movable in the vertical direction, and are mounted on a rack 210 which serves also as a roller retainer mounted vertically on a frame 250 of the sheet treating apparatus 1.

A regulating member 215 regulates the play of the trays in the front-side direction and the rear-side direction. A tray base plate 211 supports a stepping motor 202, and a pulley force-fitted onto the motor shaft drives a pulley 203 through a timing belt 212.

A shaft 213, connected to the pulley 203 with parallel pins, transmits rotary driving force to a ratchet 205 similarly connected to the shaft 213 with parallel pins, thereby biasing an idler gear 204 by a spring 206. The ratchet 205 is connected to the idler gear 204 thereby transmitting driving force thereto. The idler gear 204 is also connected to a gear 207. Another gear 207 is provided on a shaft 208 in order to drive the rack 210 at both front and rear-sides, whereby the rack 210 can be moved through a gear 209. On the tray, two rollers 214 on each side are housed in the roller retainer 210, which also serves as a rack. The trays are mounted on a base plate 211 to constitute a tray unit.

On a lateral portion 219*a* of a stacking wall 219 (FIG. 14), a plurality of grounding members 216, 216 extending through the two trays 200, 201 in the vertical direction are mounted from the front-side to the rear-side. The grounding member 216 is mounted on the stacking wall 219 by inserting elastic fingers 216*a*, 216*a* in holes 217 formed in the stacking wall 219. The elastic fingers 216*a* are protruded from plural positions of the grounding member 216 arranged in a longitudinal direction of the grounding member 216.

The grounding member 216 is made of a metal plate, a plastic mold on the surface of which a metal plate is incorporated, a plastic mold in which metal powder is mixed or a plastic mold which is plated with a metal, and is provided for receiving the trailing end of the sheets stacked on the trays 200, 201 (FIG. 1) for dissipating the electrostatic charge accumulated on the sheets and is connected to an unrepresented grounding wire connected to the exterior of the sheet treating apparatus 1.

In order that the sheet can be discharged onto the trays 200, 201, the grounding members 216 are not provided in the vicinity of the rollers 9, 180*a* as shown in FIG. 1, thereby not disturbing the sheet discharge.

The grounding members 216 serve to dissipate the electrostatic charge accumulated on the sheets, whereby, at the sheet discharge onto the trays, there is reduced the sliding resistance resulting from the mutual sticking of the sheets by the electrostatic charge, thereby resolving the defective sheet discharge. Also the sheets discharged onto the tray 200 or 201 do not mutually stick by the electrostatic charge and can be easily separated.

The electrostatic charge tends to accumulate on the sheets particularly when a large number of sheets are stacked on the tray 200 or 201, and in such situation the grounding members 216 exhibit their function of dissipating the electrostatic charge.

As the grounding members 216 are mounted by the elastic fingers 216*a* on the stacking wall 219, it is possible to separately prepare the stacking wall 219 generally by plastic molding and the grounding members 216 requiring high electric conductivity, thereby reducing the manufacturing cost.

Also in case the grounding member 216 is damaged, it can be easily detached from the stacking wall 219 and replaced by bending the elastic fingers 216*a*.

Referring again to FIG. 14, the aforementioned ratchet 205 is rendered capable of idle rotation, against the force of the spring 206, only in a direction to lift the tray, in order to prevent damage to the tray driving system by the presence of an obstacle at the descent of the tray. When such idle rotation is carried out, a sensor S201 detects a slit, incorporated in the idler gear, thereby immediately stopping the motor. This sensor is used also for detecting a desynchronization. In order to make it possible that the tray passes vertically by an opening portion of the treating tray 130 (FIG. 5), the pivotally movable guide 150 serves as a part of the stacking wall of the tray when the pivotally movable guide 150 is in the closed position. Only when a sensor (not shown) detects the closed position, the tray can be moved.

An area sensor S202 (FIG. 14) detects the flag in an area from an upper limit sensor S203*a* (FIG. 15) for preventing the excessive elevation of the tray to a treating tray sheet surface sensor S205. A sensor S203*b* for detecting the 1000 sheet position on the sample tray is provided in a position corresponding to 1000 sheets from the non-sort sheet surface sensor S204, and serves to limit the stacking amount on the sample tray 201 by the height.

Also a sensor S203*c* is provided to limit the stacking amount by the height when the sample tray 201 receives sheets from the treating tray 130, and is provided at a position corresponding to 1000 sheets from the sheet surface sensor S205. A sensor S203*d* is provided to limit the stacking amount by the height when the stack tray 200 receives sheets from the treating tray 130, and is provided at a position corresponding to 2000 sheets from the sheet surface sensor S205. A lower limit sensor S203*e* is provided for preventing excessive descent of the stack tray 200. Among the above-mentioned sensors, the sheet surface sensors S204, S205 alone are composed of transmissive sensors between the front and rear sides. Also each tray is provided with a sheet present/absent sensor 206.

The sheet surface detection is achieved by at first elevating the tray to a position until the sheet surface sensor is covered, and, after the sheet stacking, lowering the tray until the optical axis of the sheet surface sensor is uncovered and elevating the tray until the optical axis of the sheet surface sensor is again covered. This operation is reiterated.

In the following there will be explained the punch unit 50 with reference to FIGS. 15 to 20.

Figure 16:
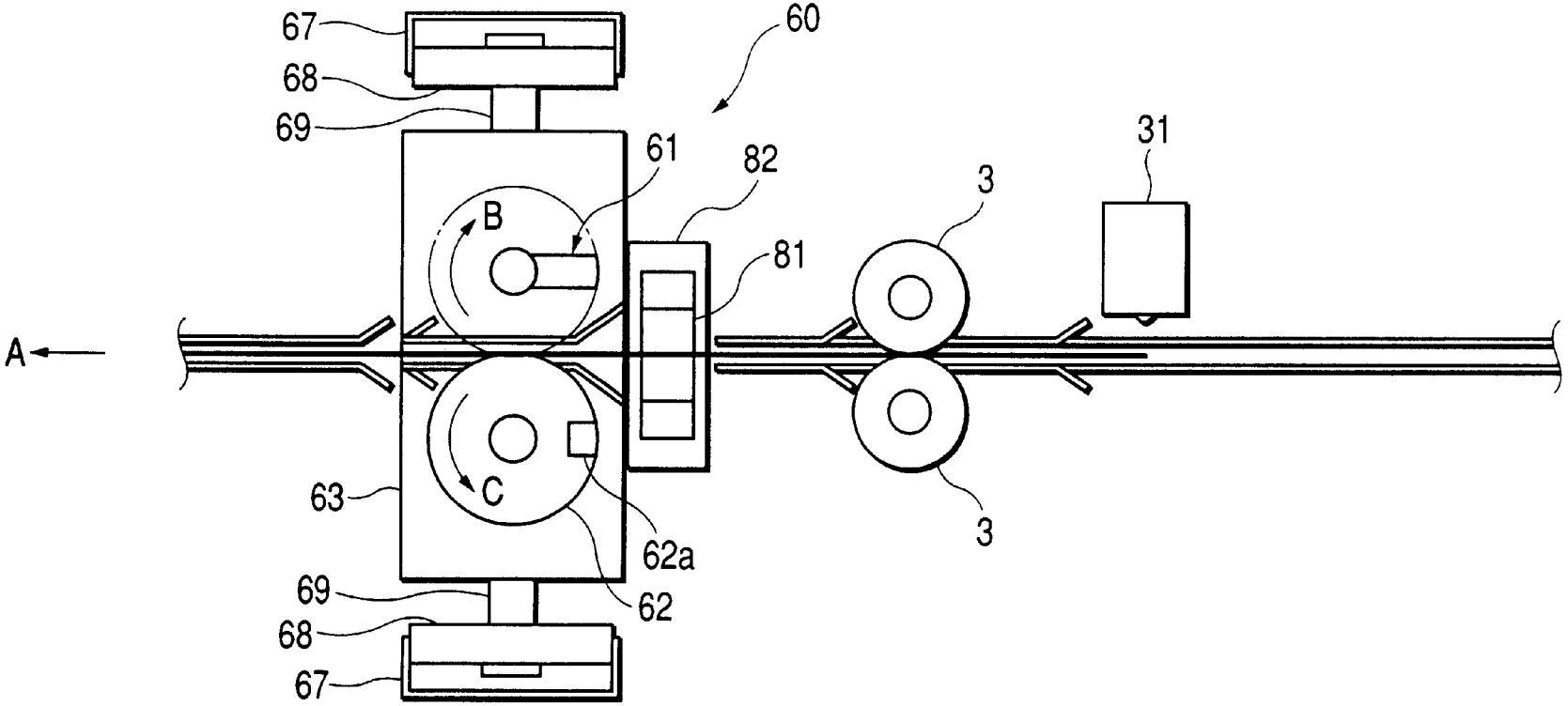
FIGS. 16 and 17 are side views of a punch unit.
Figure 17:
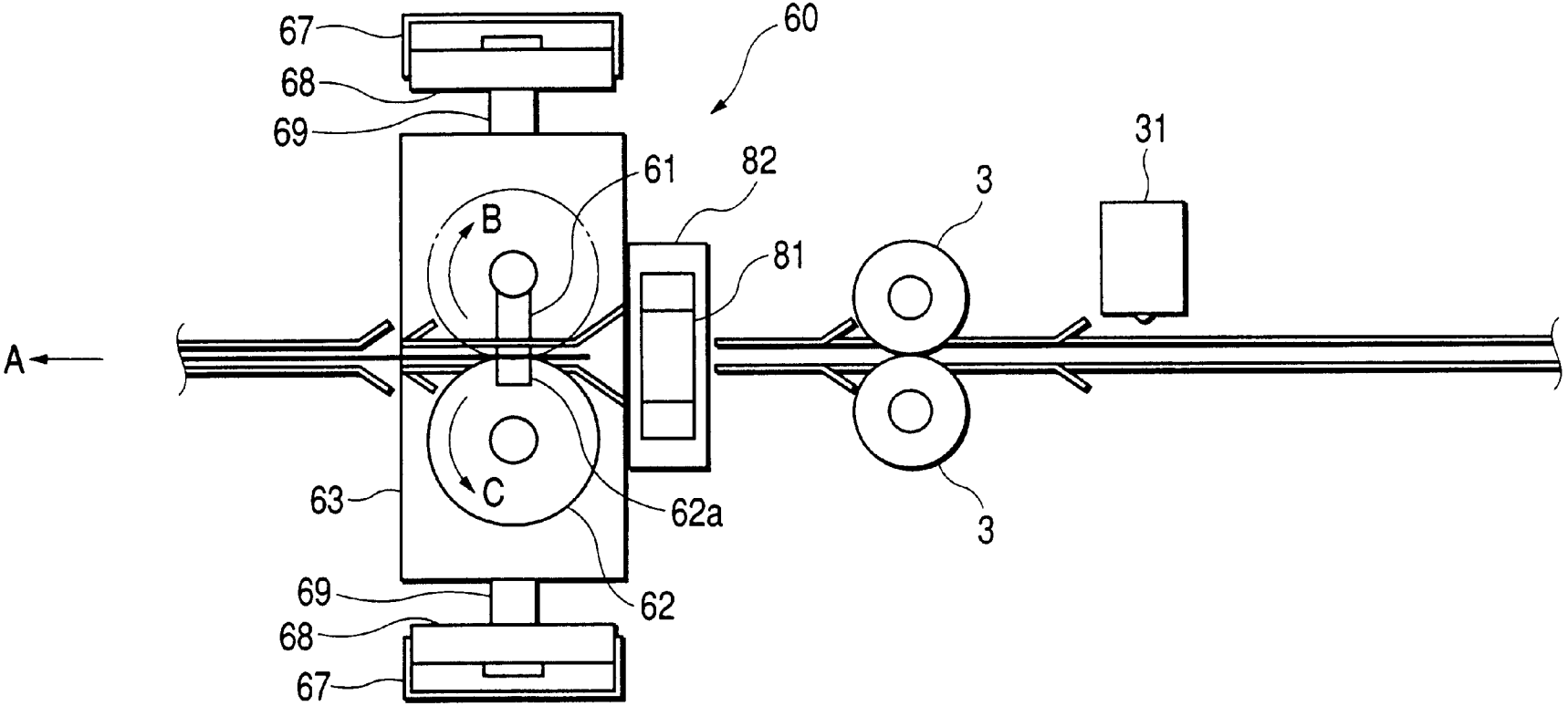
Figure 18:
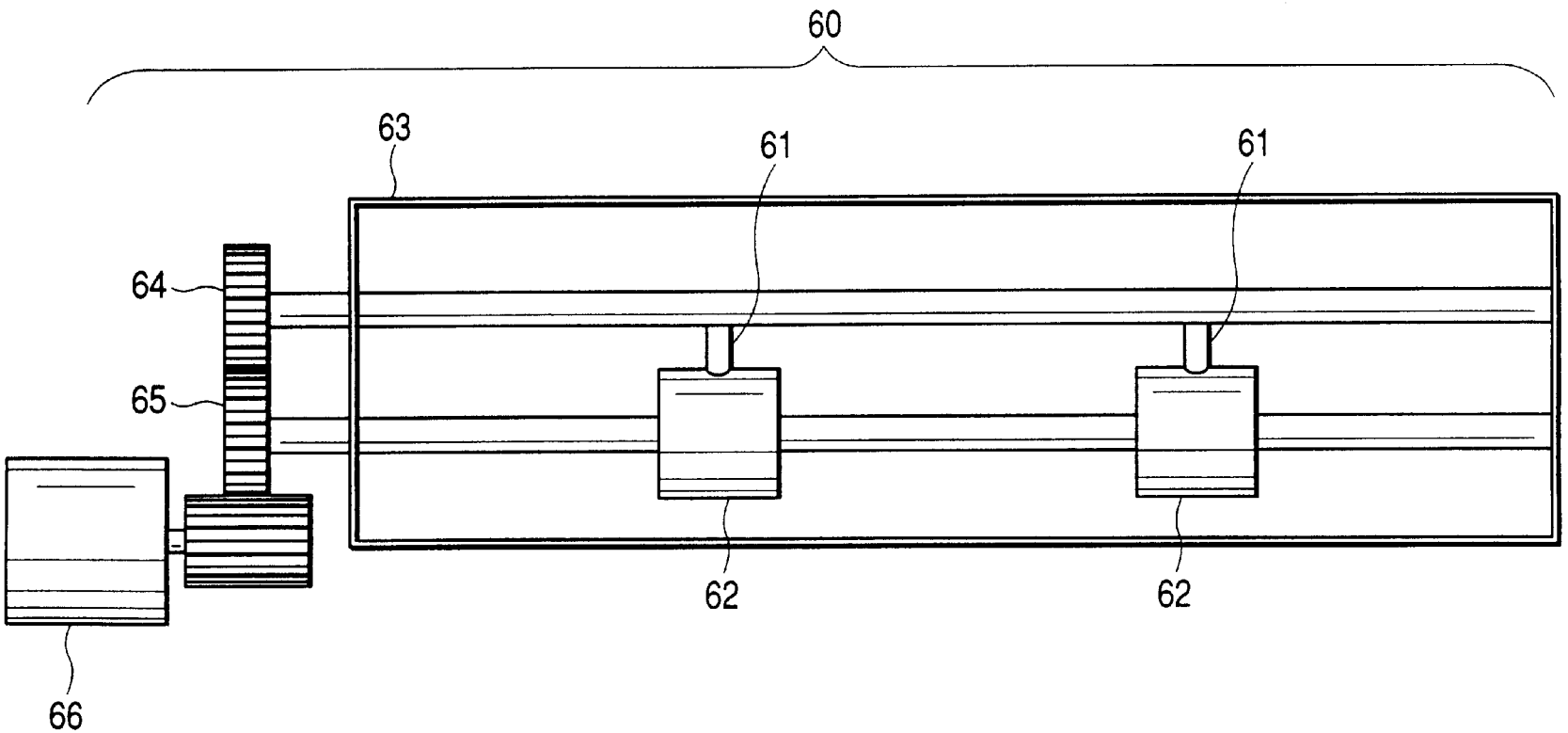
FIG. 18 is a plan view of the punch unit.
Figure 19:
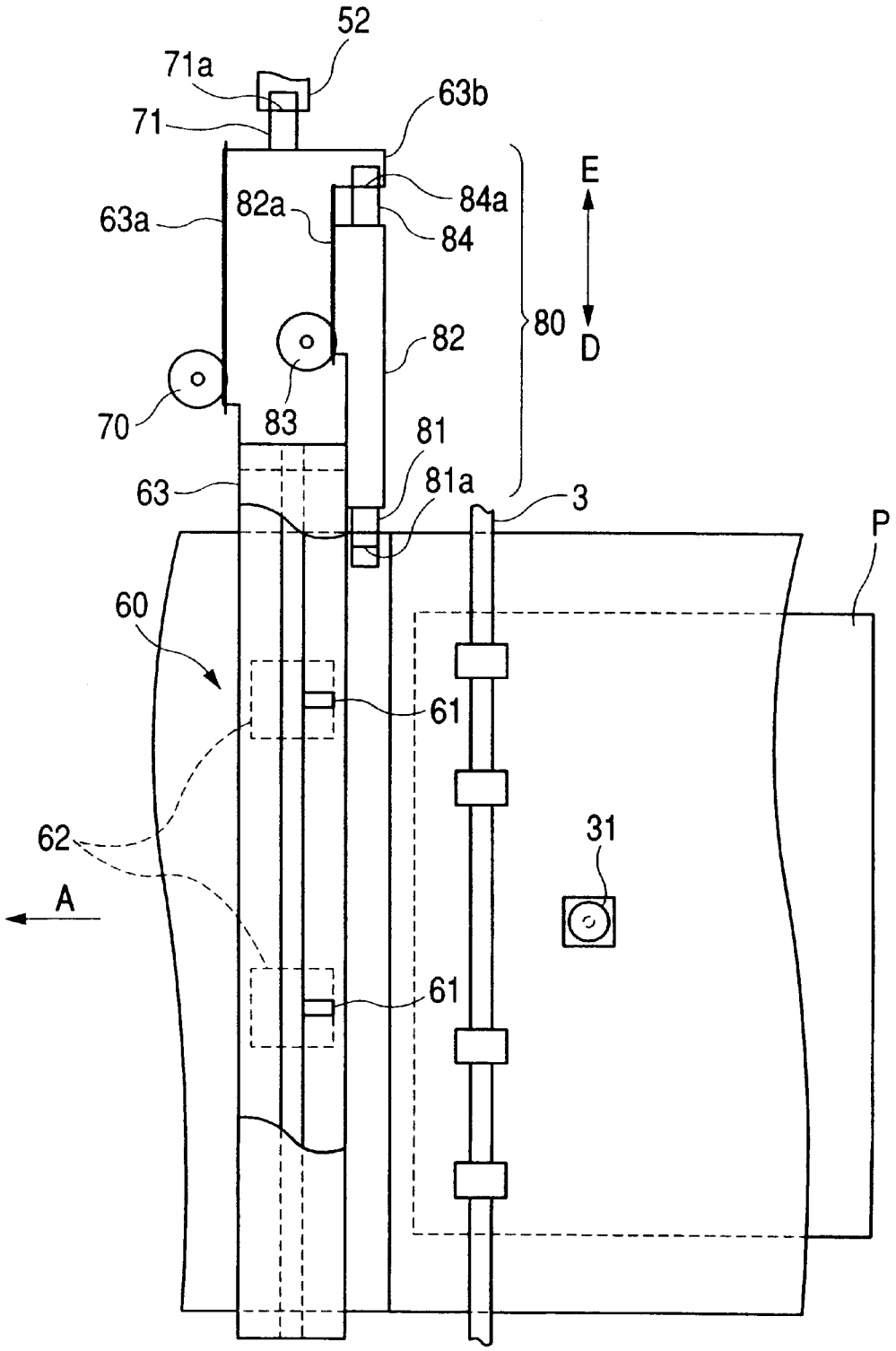
FIGS. 19 and 20 are views showing a lateral registration sensor moving mechanism of the punch unit.
Figure 20:
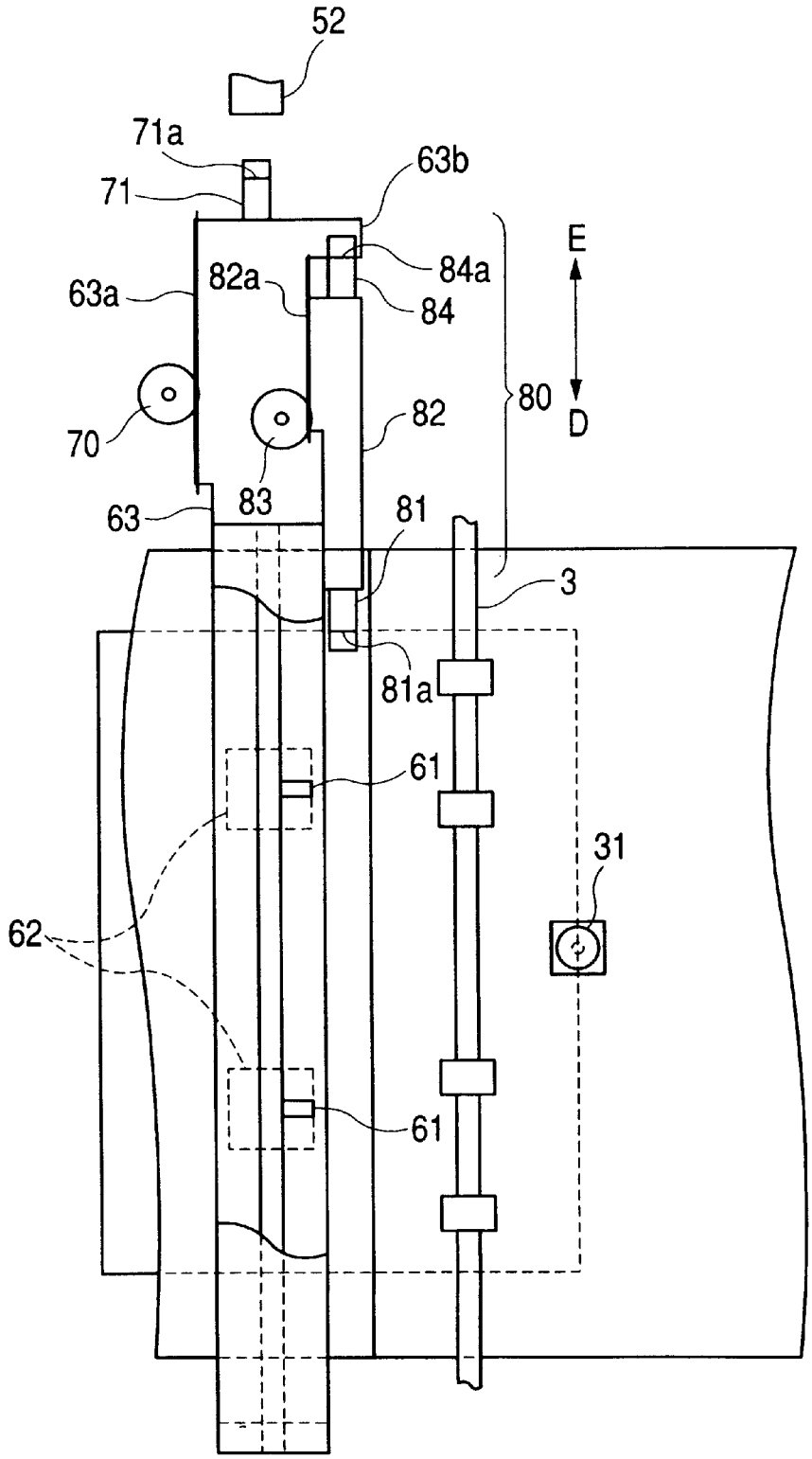

The punch unit 50 is provided with punching means 60 and lateral registration detection means 80. A punch 61 and a die 62 of the punching means 60 are respectively supported in casings 63 and are rendered rotatable in directions indicated by arrows B, C in mutual synchronization by mutually meshing respective gears 64, 65 driven by a punch drive motor 66. The punch 61 and the die 62 normally wait in a home position shown in FIG. 16. After the detection of the trailing end of the sheet by the sheet sensor 31, the punch drive motor 66 (FIG. 18) is driven at a predetermined timing whereby the punch 61 and the die 62 respectively rotate in the directions indicated by the arrows B, C as shown in FIG. 16 and the punch 61 engages with a die hole 62*a* provided in the die 62 thereby punching the conveying sheet.

In this operation, the punching of the sheet in conveyance can be achieved by maintaining the rotating speed of the punch 61 and the die 62 the same as that of the aforementioned conveying rollers 3. Guide portions 67 are provided for moving the punching means 60 perpendicularly to the conveying direction A of the sheet. Rollers 68 rotating in contact with the guide portions 67 are caulked to the casings 63 by roller shafts 69.

A rack 63*a*, formed in a part of the casing 63 (FIG. 19), meshes with a pinion 70 provided in an unrepresented punching means moving motor. A punching means initial position sensor 71, having a light-receiving portion 71*a* parallel to the sheet conveying direction indicated by arrow A, is mounted on the casing 63.

Thus, by the driving force of the unrepresented punching means driving motor, the punching means 60 can move in directions indicated by double-headed arrow D, E perpendicularly to the sheet conveying direction A. A punching means initial position defining portion 52 can be detected by the light-receiving portion 71*a* by a movement of the punching means initial position sensor 71 in the direction E. The initial position of the punching means is selected several millimeters in front of the sheet reference position, corresponding to the declination resulting from skewed feed or aberration in lateral registration.

The lateral registration detection means 80 is mounted on the punching means 60. The lateral registration detection means 80 is provided, at the front end of a sensor arm 82, with a lateral registration sensor 81 having a light-receiving portion 81*a* parallel to the sheet conveying direction A and adapted to detect the side edge of the sheets.

The sensor arm 82 is provided, in a part thereof, with a rack 82*a*, meshing with a pinion 83 provided on an unrepresented lateral registration moving motor which is mounted on the casing 63. On the rear end of the sensor arm 82, there is mounted a lateral registration initial position sensor 84 having a light-receiving portion 84*a* parallel to the light receiving portion 81*a*.

Thus, by the driving force of the unrepresented lateral registration movement motor, the lateral registration sensor 81 and the lateral registration initial position sensor 84 can be moved in the direction indicated by the double-headed arrow D, E perpendicular to the sheet conveying direction A. A lateral registration initial position defining portion 63*b* provided on the casing 63 can be detected by the light-receiving portion 84*a* by the movement of the lateral registration initial position sensor 84 in the direction E. Also the lateral registration sensor 81 can be set at a position corresponding to the selected sheet size, by the movement of the lateral registration sensor 81 in the direction D.

In detecting the side edge of the sheet, after the aforementioned sheet sensor 31 detects the leading end of the sheet, the unrepresented punching means moving motor is driven at a predetermined timing to move the punching means 60 and the lateral registration sensor 81 in the direction D, and the movement is terminated upon detection of the side edge of the sheet when the light-receiving portion 81*a* of the lateral registration sensor 81 is intercepted by the side edge of the sheet. It is therefore possible to regulate the punching position according to the side edge of the sheet.

In the following there will be explained the flow of the sheet P.

In FIGS. 21 to 26, 30 and 31, the operations of the trailing end dropping member 181, the knurled belt 182 etc. are the same as those already explained with reference to FIGS. 5 to 10 and will not, therefore, be explained further.

Figure 21:
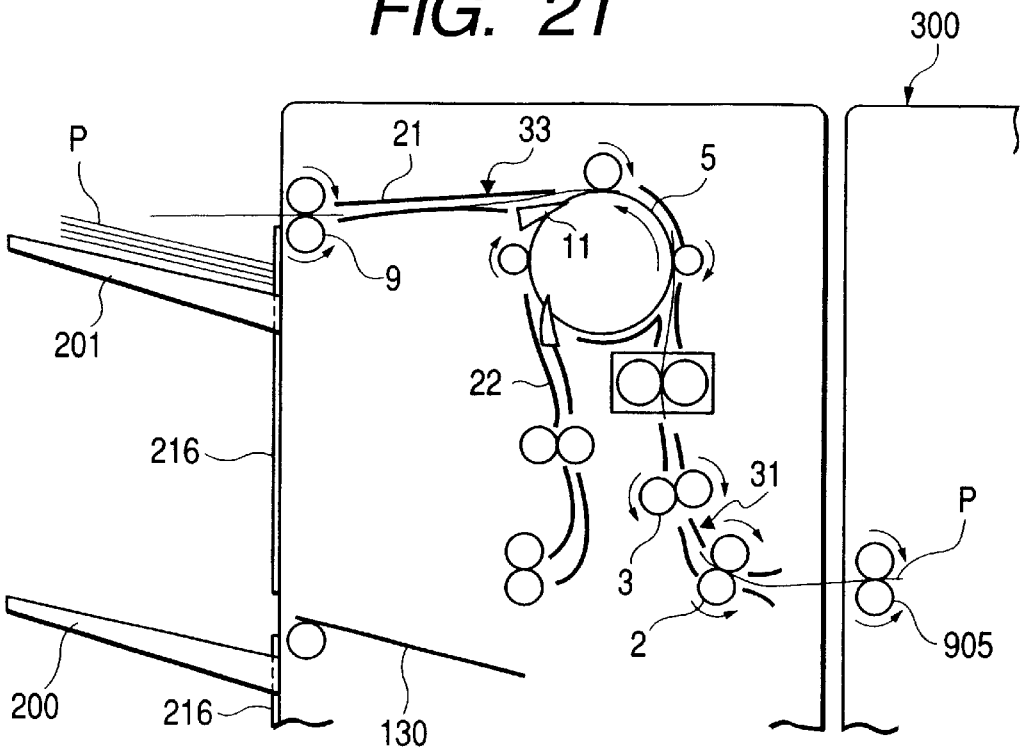
FIG. 21 is a view illustrating an operation of the sheet treating apparatus in a non-sort mode.

When the user selects the non-sort mode on an operation unit (not shown) of the main body of the image forming apparatus, the paired entrance rollers 2, conveying rollers 3 and large conveying roller 5 are rotated to convey the sheet P, conveyed from the main body 300 of the image forming apparatus and bearing the image thereon, as shown in FIG. 21. The flapper 11 is shifted by a solenoid (not shown) to the illustrated position to convey the sheet P to the non-sort path 21. When the sensor 33 detects the trailing end of the sheet P, the rollers 9 are rotated at a speed suitable for stacking, thereby discharging the sheet P onto the sample tray 201. The discharged sheet P is received, at the trailing end thereof, by the grounding member 216 and is grounded, whereby the electrostatic charge accumulated on the sheet is dissipated.

Consequently the sheets P do not stick mutually and can be easily separated one by one. Also the user can be relieved from the electrical shock when grabbing the sheet P.

In the following there will be explained the operation when the staple sort mode is selected by the user.

Figure 22:
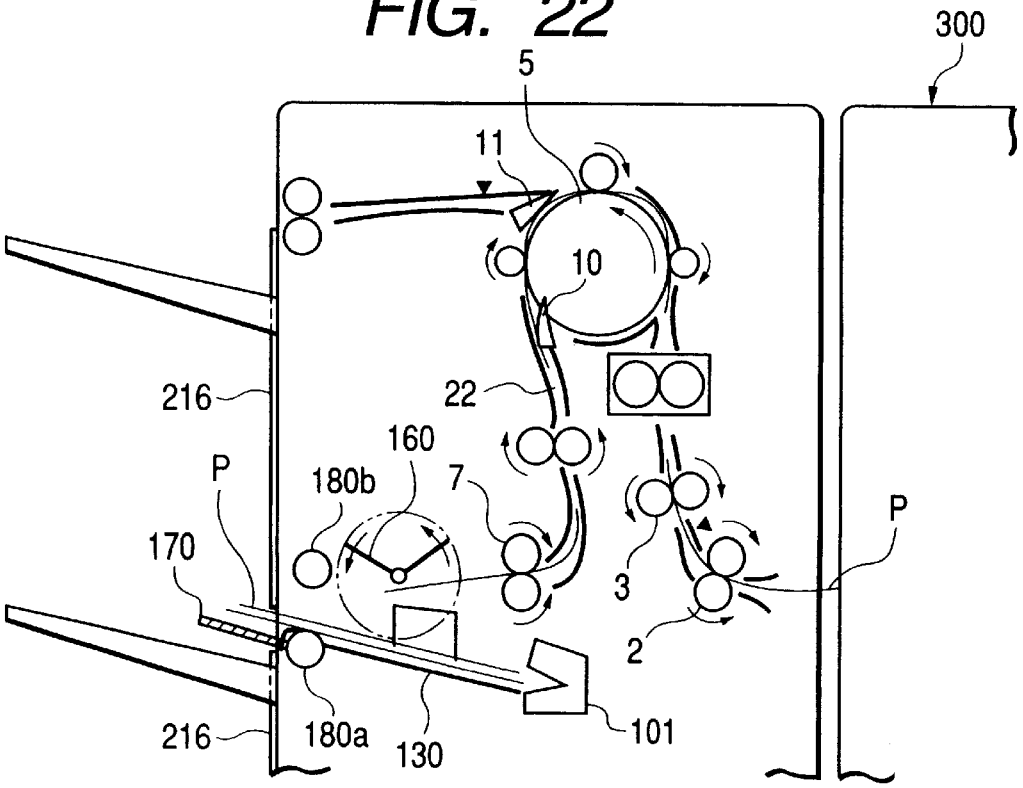
FIGS. 22 to 28 are views illustrating an operation of the sheet treating apparatus in a staple sort mode.

As shown in FIG. 22, the paired entrance rollers 2, the conveying rollers 3 and the large conveying roller 5 are rotated to convey the sheet P conveyed from the main body 300 of the image forming apparatus. The flappers 10, 11 are maintained in positions shown in FIG. 22. The sheet P passes the sort path 22 and is discharged by the discharge rollers 7 to the stapler 101. In this state, the retractable tray 170 is in the protruding position, thereby receiving the leading end of the sheet P discharged from the discharge rollers 7 and preventing the sheet P from hanging, thus avoiding insufficient recovery of the sheet P and improving the sheet alignment on the treating tray.

The discharged sheet P starts to move, by the self-weight thereof, toward the trailing end stopper 31 (FIG. 5), and the paddle 160, stopped at the home position, starts to rotate counterclockwise by the motor M160 to assist the sheet movement mentioned above. When the trailing end of the sheet P is stopped by securely abutting against the stopper 131, the rotation of the paddle 160 is stopped and the discharged sheet is aligned by the front-side alignment mechanism 141 and the alignment member 142.

The aligning operation for the sheet P will be explained later.

Figure 23:
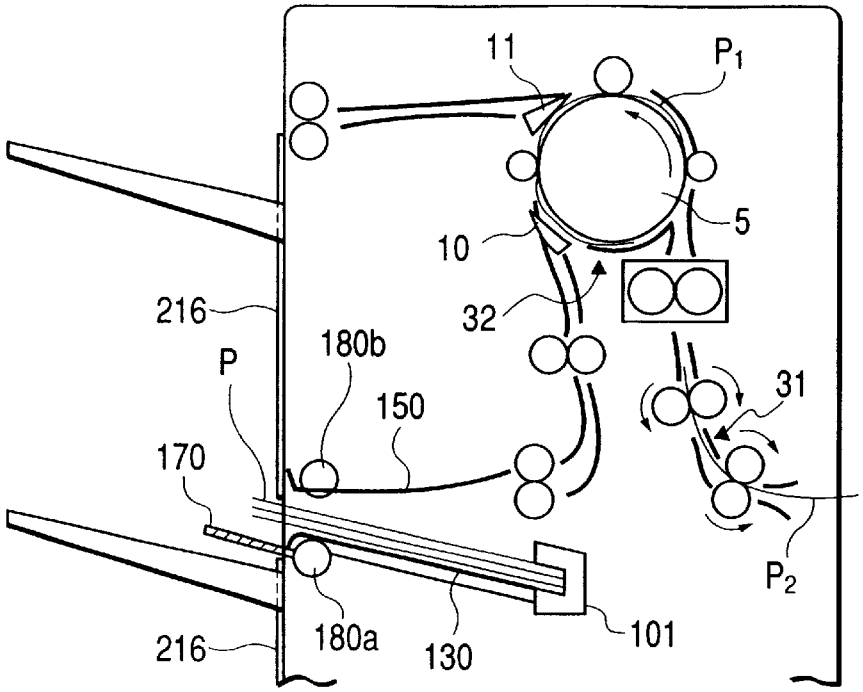

When all the sheets of a first copy are discharged and aligned on the treating tray 130, the pivotally movable guide 150 is lowered as shown in FIG. 23 whereupon the roller 180*b* rests on the sheet bundle and the stapler 101 staples the bundle of the sheets.

Figure 24:
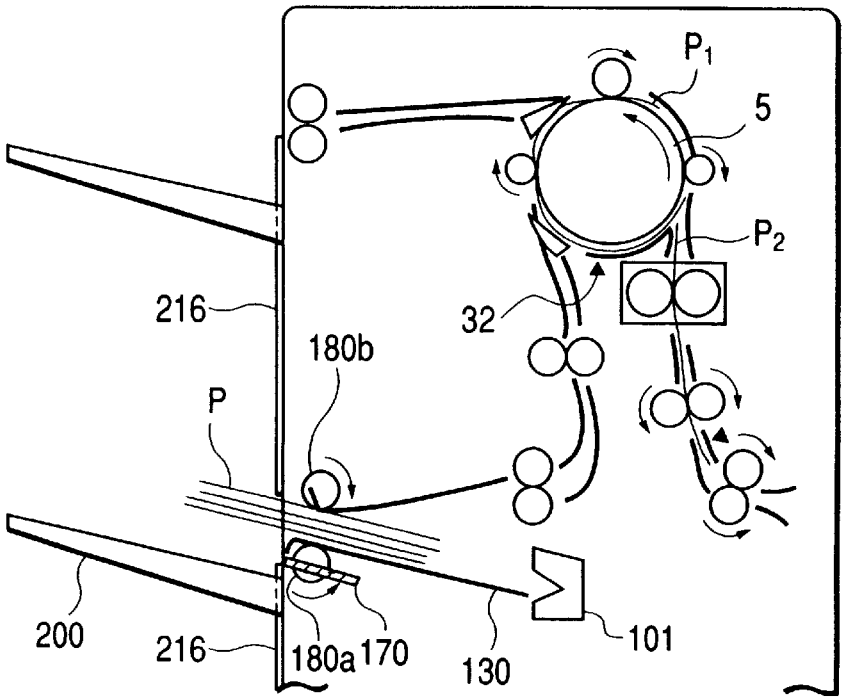
Figure 25:
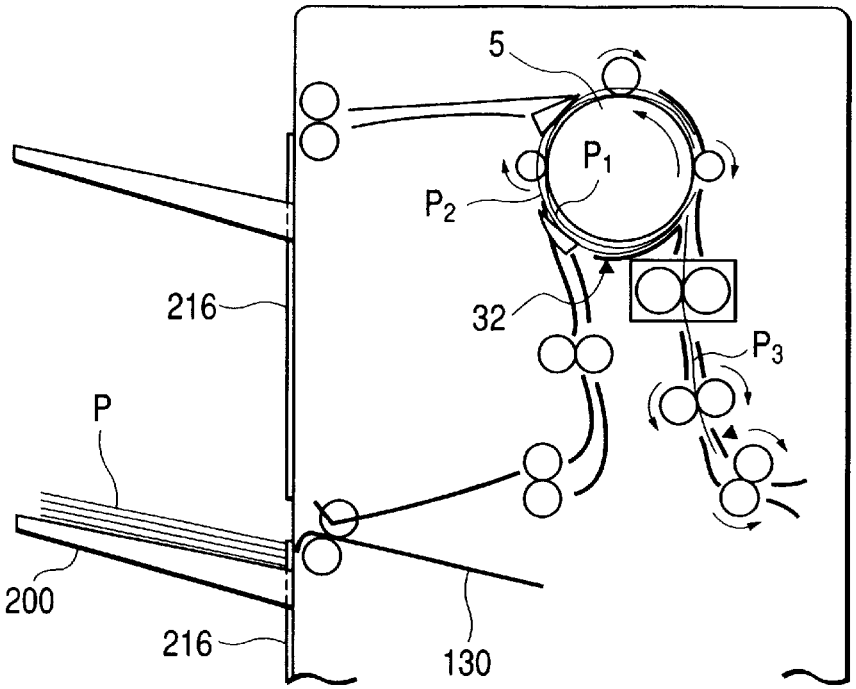

On the other hand, a sheet P1 discharged in the meantime from the main body 300 of the image forming apparatus is guided by the flapper 10 and wound around the large conveying roller 5 as shown in FIG. 23 and is stopped at a predetermined distance after the sensor 32. When a next sheet P2 advances by a predetermined distance from the sheet sensor 31, the large conveying roller 5 is rotated as shown in FIG. 24 to superpose the second sheet P2 on the first sheet P1 in such a manner that the second sheet P2 precedes the first sheet P1 by a predetermined distance, and the second sheet P2 is wound around the large conveying roller 5 as shown in FIG. 25 and is stopped after advancement by a predetermined distance. On the other hand, the sheet bundle on the treating tray 130 is discharge onto the stack tray 200 as shown in FIG. 25 and the electrostatic charge eventually accumulated on the sheet bundle is dissipated by the grounding members 216.

Figure 26:
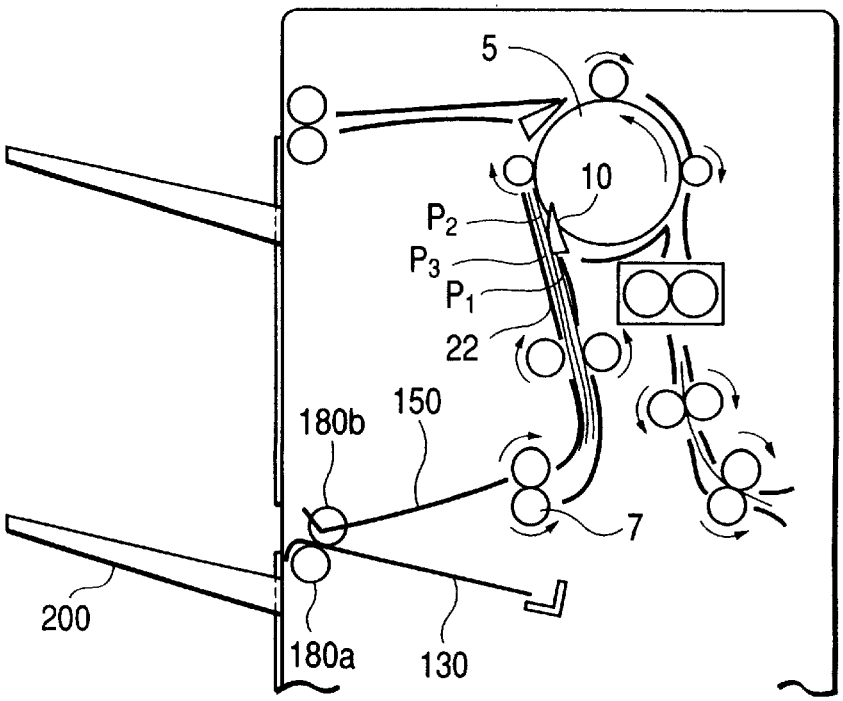

In this operation, the retractable tray 170 is moved to the home position, before the sheet bundle passes through the discharged sheet bundle rollers, in order to drop the sheet bundle onto the stack tray 200. When a third sheet P3 reaches a predetermined position, the large conveying roller 5 is rotated as shown in FIG. 26 to superpose the sheet P3 with a displacement by a predetermined distance, and the flapper 10 pivots to convey the three sheets P to the sort path 22.

Figure 27:
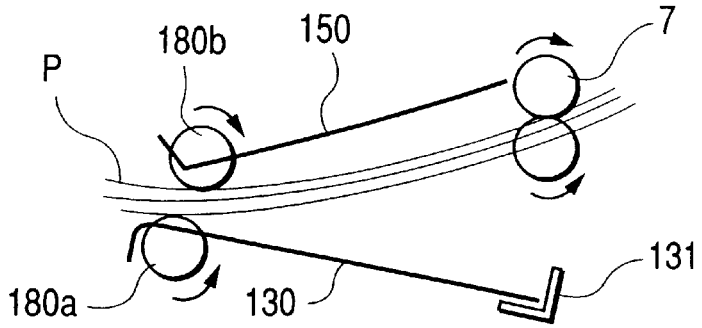
Figure 28:
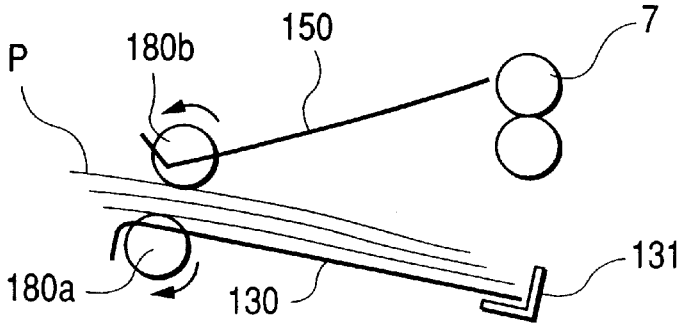
Figure 29A:
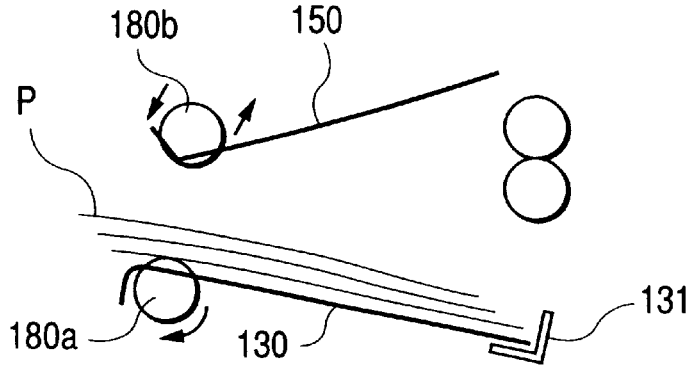
FIG. 29A is a view illustrating an operation of the sheet treating apparatus when the pivotally movable guide is elevated in the staple sort mode.

The three sheets P are received by the rollers 180*a*, 180*b* while the pivotally movable guide 150 is in the lowered state as shown in FIG. 27, and, when the trailing end of the sheets P passes through the rollers 7, the rollers 180*a*, 180*b* are reversely rotated as shown in FIG. 28, and, before the trailing end comes into contact with the stopper 131, the pivotally movable guide 150 is elevated as shown in FIG. 29A whereby the roller 180*b* is separated from the sheet surface. Fourth and subsequent sheets P are discharged, in the same manner as the sheets of the first copy, onto the treating tray 130 through the sort path 22. The operations for the third or subsequent copies are treated in the same manner as the second copy, and the predetermined number of copies are thus stacked on the stack tray 200 to finish the operation.

Figure 29B:
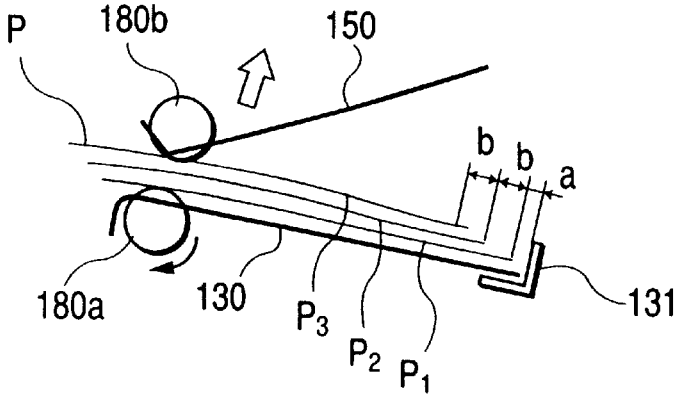
FIG. 29B is a view illustrating an operation of the sheet treating apparatus when the pivotally movable guide is lowered in the staple sort mode.

In the above-described conveying of superposed plural sheets, the sheets P are mutually offset in the conveying direction as shown in FIG. 29B. The sheet P2 is offset in the downstream side with respect to the sheet P1, and the sheet P3 is offset in the downstream side with respect to the sheet P2.

The offset amount of the sheets P and the timing of elevation of the pivotally movable guide 150 are related to the sitting time of the sheets, dependent on the returning speed of the bundle discharge rollers 180*a*, 180*b*, and are therefore determined by the processing ability of the main body 300 of the image forming apparatus. In the present embodiment, for a sheet conveying speed of 750 mm/s, an offset amount b of about 20 mm and a returning speed 500 mm/s of the bundle discharge rollers, the bundle discharge rollers are designed to be separated at a timing when the sheet P1 reaches a position of about 40 mm (valve of "a") in front of the contact position with the stopper 131.

In the following there will be explained the sort mode.

Figure 30:
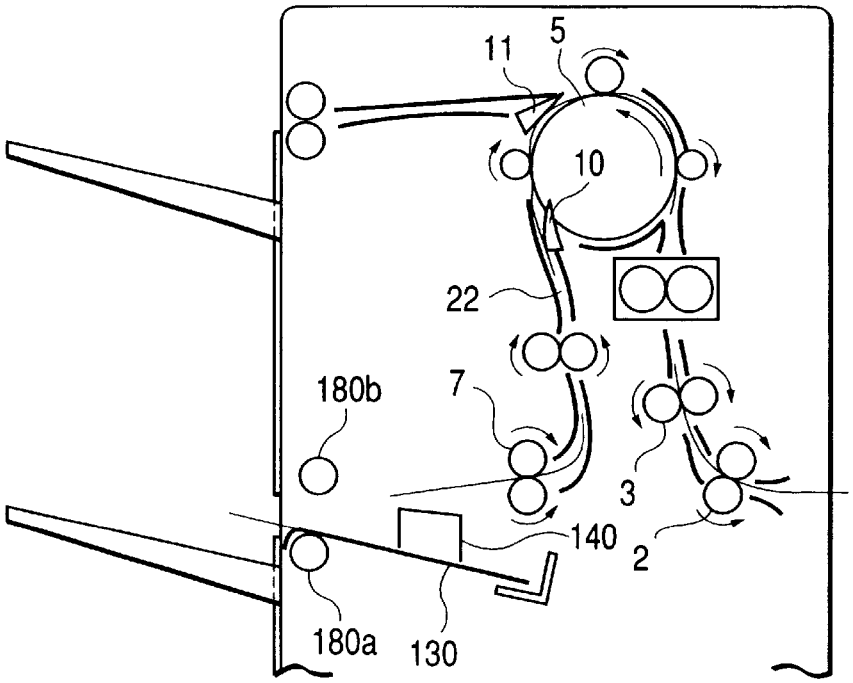
FIGS. 30 and 31 are views illustrating an operation of the sheet treating apparatus in a sort mode.
Figure 31:
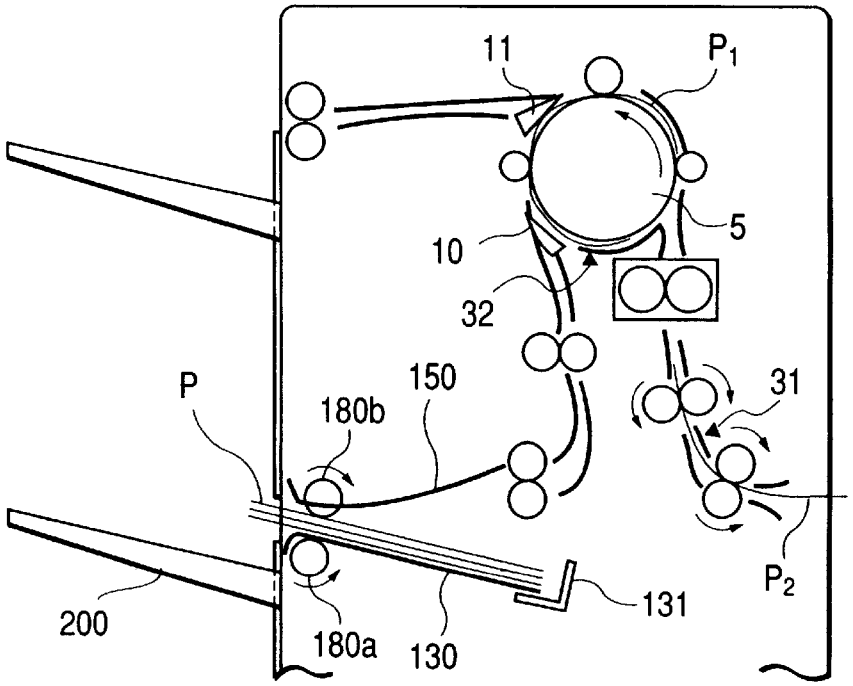

The user sets the originals on the RDF 500, selects the sort mode on the operation unit (not shown) and depressed a start key (not shown). The entrance rollers 2 and the conveying rollers 3 rotate as shown in FIG. 30, as in the staple sort mode, thereby stacking the sheets on the treating tray 130. The sheets P on the treating tray 130 are aligned by the aligning device 140. After a small number of sheets P are stacked and aligned on the treating tray 130, the pivotally movable guide 150 is lowered as shown in FIG. 31 to convey the bundle of the sheets of small number.

A next sheet P passes over the flapper 10, is wound around the large roller 5 as in the staple sort mode and is discharged onto the treating tray 130 after the discharge of the bundle. When the number of sheets in the discharged bundle of small sheet number is for example 20 sheets or less, such number is so selected as to satisfy a relation:

number of originals≧sheet number in a discharged bundle≦20

(however, this relation is not binding when the sheets are stapled). Thus, for example if the number of sheets in the bundle is selected as 5 sheets in programming, each bundle is discharged with 4 sheets in case the number of originals is 4. In case the number of the originals is larger than 5, for example 14, the sheets are divided into bundles of 5+5+4 which are respectively aligned and discharged.

In the present embodiment, the number of sheets in a bundle may exceed 20 in case the bundle is stapled.

Figure 38:
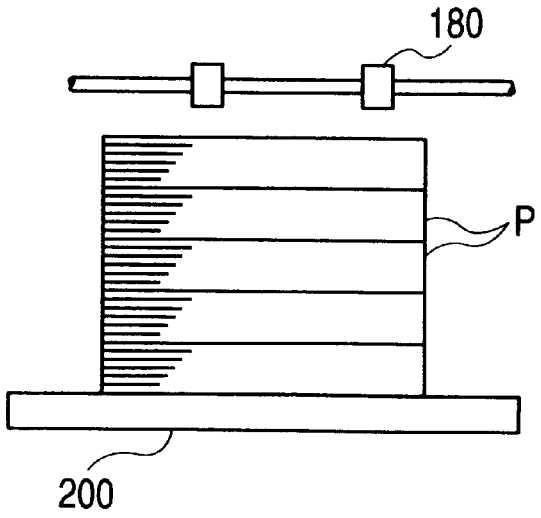

The controlling circuit 301 receives, from the controlling means 930 of the main body 300 of the copying machine, the number of sheets per bundle, entered by the user. For example, if a bundle contains 39 sheets, there is executed offset control. In case a bundle contains 40 or more sheets, the offset control is not executed but the sheet bundles P are stacked as shown in FIG. 38.

In case the offset control is executed, after the discharge of the first stapled bundle, the front-side aligning mechanism 141 is moved together with the rear-side aligning member 142, whereby the aligning position for the second copy is offset with respect to that for the first copy. This operation will be explained later in more details.

The second copy is aligned in thus offset position, stapled in the same manner as the first copy and discharged as a bundle. After the discharge of the second bundle, the rear-side aligning member 142 moves to a further rearward position, and the front-side aligning mechanism 141 aligns the sheets, using the rear-side aligning member 142 as reference, thereby further offsetting the aligning position for the third copy with respect to that for the second copy.

The third copy is aligned in thus offset position, stapled in the same manner as the second copy and discharged as a bundle.

After the discharge of the third bundle, the front-side aligning member 141 moves to a near position together with the rear-side aligning member 142, thereby returning the aligning position for the fourth copy to that for the first copy.

Thereafter the procedure is repeated in a similar manner to offset the fifth copy to a position same as that for the second copy.

Figure 32:
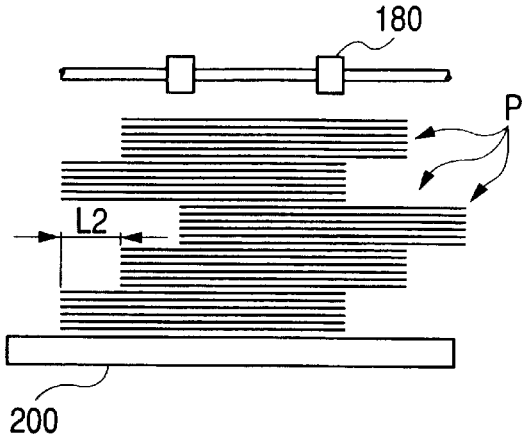
FIG. 32 is a view showing stacked sheet bundles.

In this manner all the copies are offset in the unit of a bundle, as shown in FIG. 32.

Now there will be explained the aligning operation.

The controlling circuit 301 executes following three controls, based on the number of sheets in a bundle, designated by the user, and the presence or absence of selection of the sheet stapling mode.

Figure 37:
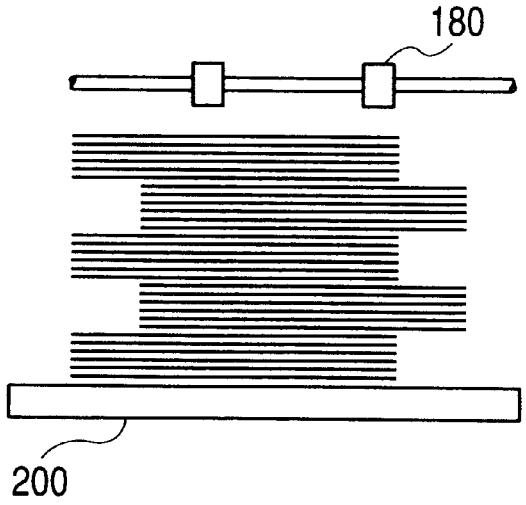
FIGS. 37 and 38 are views showing stacked sheet bundles.

Firstly, the controlling circuit 301 executes offset control as shown in FIGS. 32 or 37, in case the user designates the number of sheets in the bundle not exceeding a predetermined number (for example 39 sheets or less) and does not select the sheet stapling mode.

Secondly, the controlling circuit 301 executes offset control as shown in FIGS. 32 or 37 also in case the user designates the number of sheets in the bundle not exceeding a predetermined number (for example 39 sheets or less) and selects the sheet stapling mode.

Thirdly, the controlling circuit 301 executes offset control as shown in FIGS. 32 or 37 also in case the user designates the number of sheets in the bundle exceeding a predetermined number (for example 40 sheets or more) and does not select the sheet stapling mode.

Fourthly, the controlling circuit 301 does not execute offset control but executes such control as to stack the sheet bundles in a same position as shown in FIG. 38, in case the user designates the number of sheets in the bundle exceeding a predetermined number (for example 40 sheets or more) and selects the sheet stapling mode.

The first and second controls mentioned above are only different in that the sheets are stapled or not, and hardly need be distinguished in the explanation of the aligning operation. Therefore, the aligning operation will be explained in the following principally on the first control, but the operation based on the second control will also be explained at the same time.

The controlling circuit 301 selects one of the above-described controls, based on the number of sheets designated by the user in the bundle and the presence or absence of selection of the stapling mode.

In the present embodiment, there will be explained a case of offsetting in three positions, but the number of offset positions is not restrictive. The offsetting in three positions is achieved by taking the sheet bundle in the center as reference.

Figure 33:
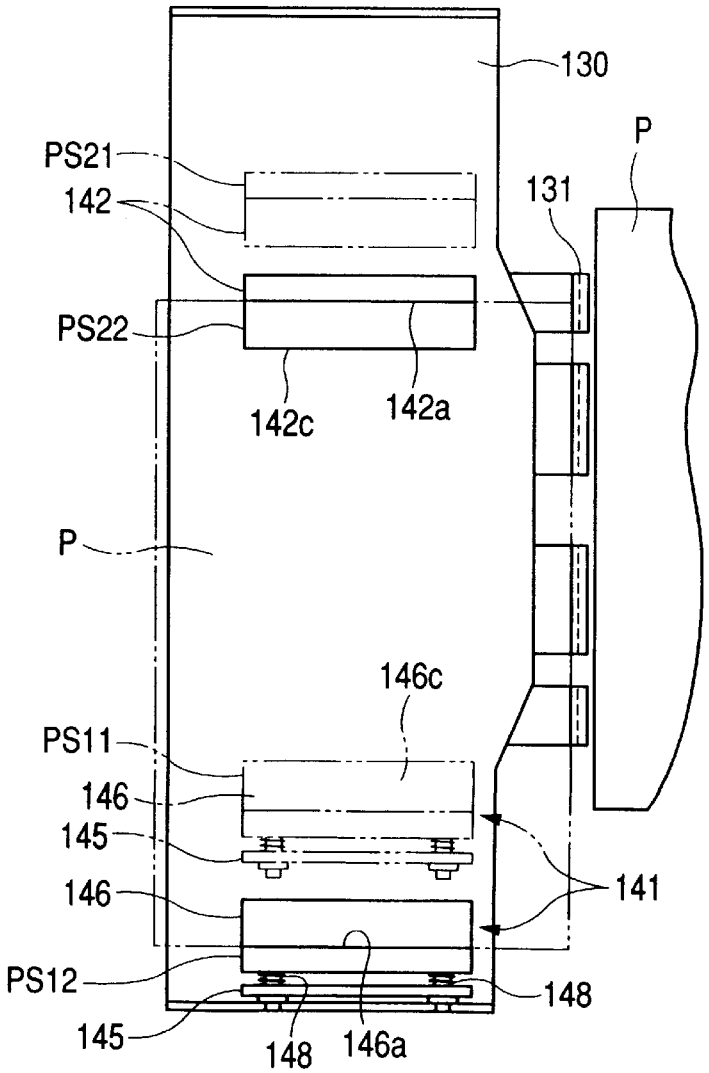
FIG. 33 is a plan view showing a sheet bundle aligning operation of the treating tray.
Figure 34:
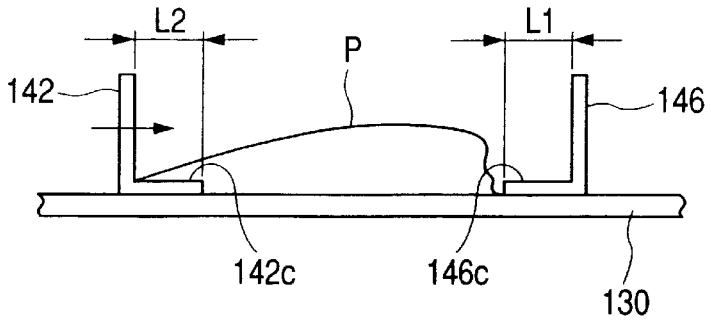
FIG. 34 is a side view showing the sheet bundle aligning operation of the treating tray.

At first, in the absence of sheet on the treating tray 130, as shown in FIG. 33, the front-side aligning member 146 and the rear-side aligning member 142 wait in home positions PS11, PS21 which are mutually apart somewhat wider than the width of the sheet conveyed from the sort path 22.

When the first sheet P is to be discharged, the front-side aligning mechanism 141 moves from the home position to a first aligning position PS12, but the rear-side aligning member 142 still wait in the home position PS21.

When the first sheet P is discharged onto the treating tray 130, the first sheet P is supported by the supporting surfaces 146*c*, 142*c* of the aligning members, and the trailing end of the sheet is received by the trailing end stopper 131. In this state, the rear-side aligning member 142 moves to a first aligning position PS22, and the sheet is aligned to the first aligning position by the aligning surface 142*a* of the rear-side aligning member 142 and the aligning surface 146*a* of the front-side aligning member 146. In this state, the distance between the aligning surfaces 142*a*, 146*a*, namely the distance between the first aligning positions PS22, PS12, is slightly wider than the sheet width, more specifically by about 2 mm.

Then, in preparation for the discharge of a next sheet, the front-side aligning mechanism 141 waits in the position PS12, but the rear-side aligning member 142 returns to the home position PS21. When the next sheet is discharged, the rear-side aligning member 142 moves to the first aligning position PS22 to align the sheet.

Thus, for each sheet discharge, the rear-side aligning member 142 moves between the home position PS21 and the first aligning position PS22, thereby aligning the sheet in the direction of width in cooperation with the front-side aligning member 142. During this operation, the front-side aligning member 146 stops at the first aligning position PS21, constituting the reference position for the first aligning position.

The above-described operation is continued until the last sheet in the same bundle, but, because the number of sheet in the bundle is relatively limited (39 sheets or less), the aligning member 142 can move to the first aligning position PS22 properly selected for the sheet width and can align the sheets, without pressing the sheets, against the force of the spring 148 provided in the compressed state on the front-side aligning mechanism 141.

The spring 148 is provided for absorbing the shock of the aligning operation.

The spring 148 is provided in the compressed state because, if provided in a state of free length, it is compressed to a length balanced with the slight pressure of the sheets whereby the front-side aligning member 146 is displaced from the reference position for the first aligning position.

Figure 11:
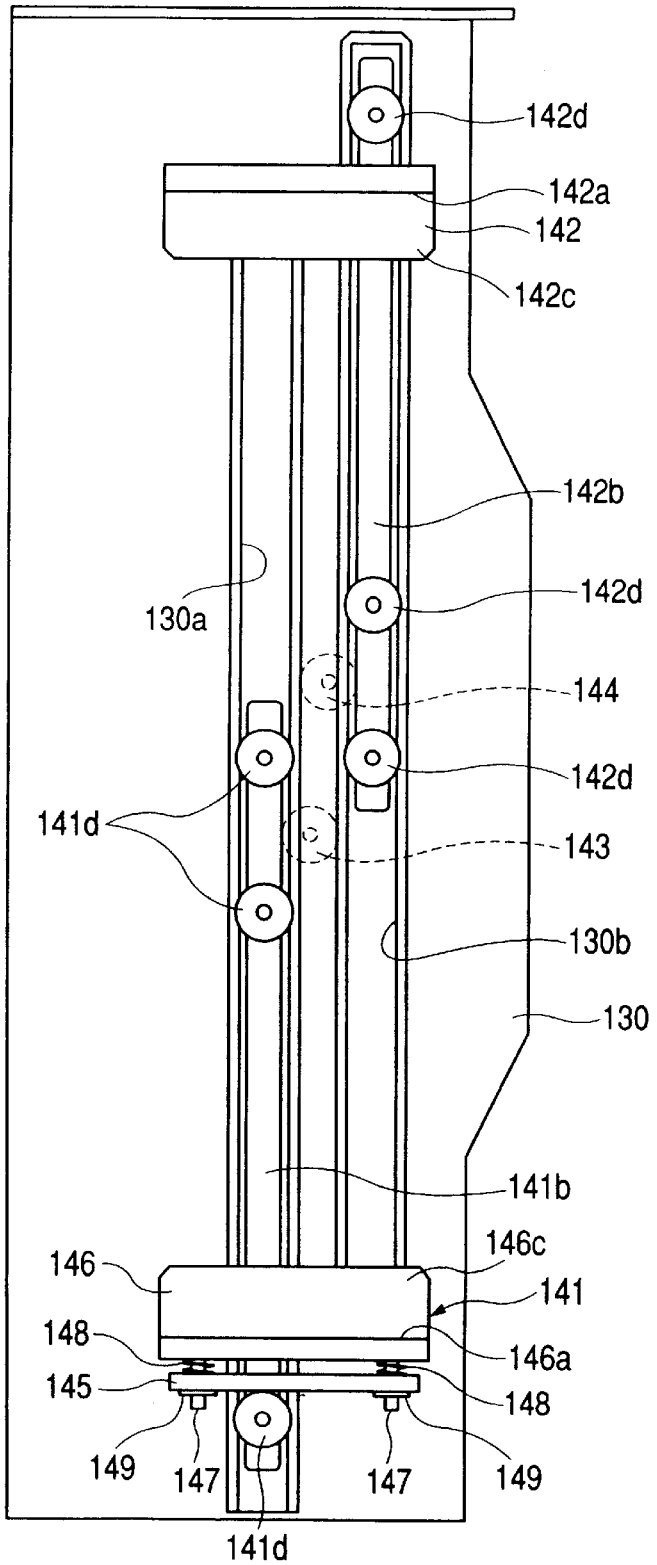
FIG. 11 is a plan view of a treating tray and an alignment member moving mechanism.
Figure 12:
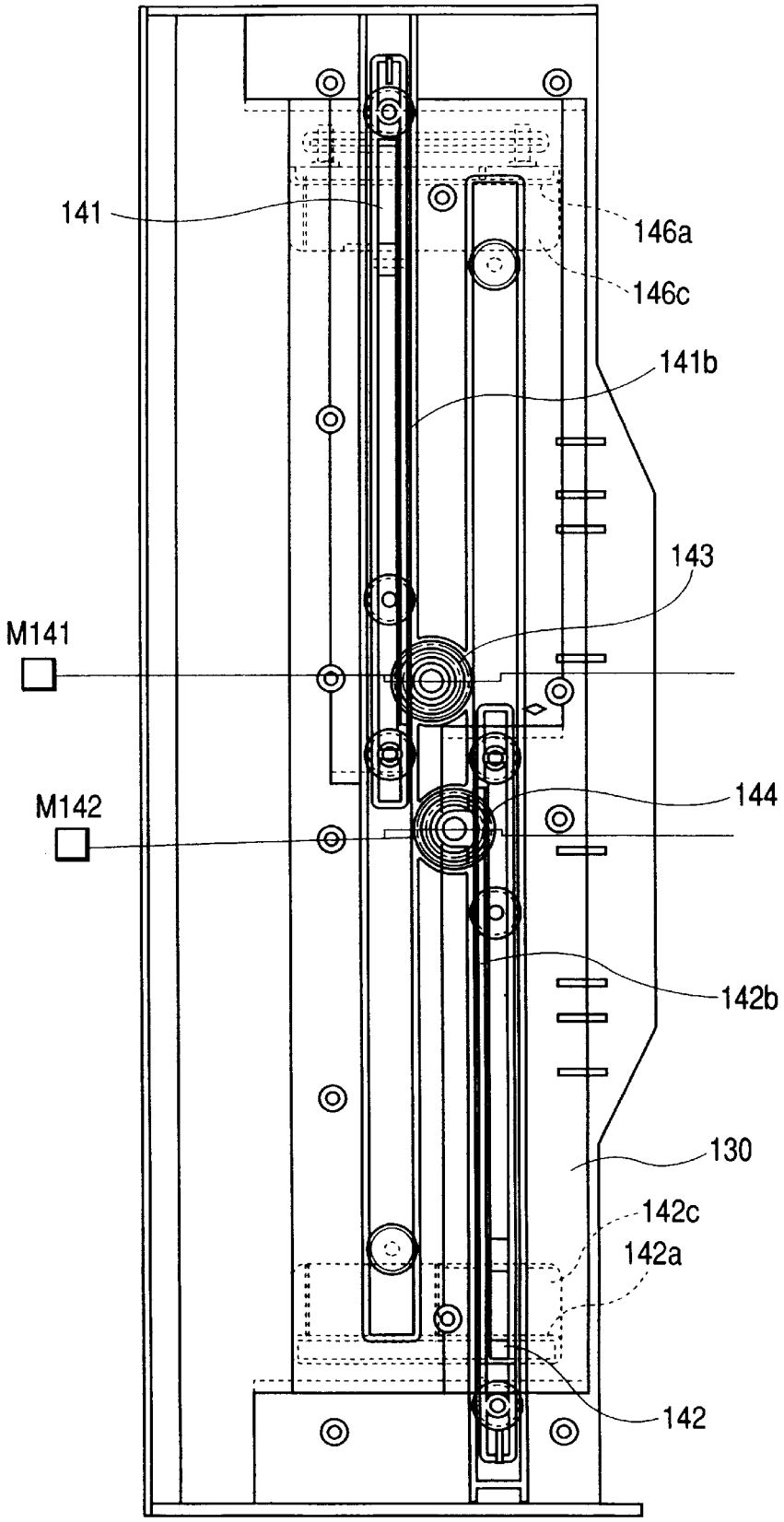
FIG. 12 is a bottom view of the treating tray and the alignment member moving mechanism.

The position of the rear-side aligning member 142 is controlled by detecting the sheet with the sensor 183 provided in the sort path 22 shown in FIG. 5, counting the sheets by the controlling circuit 301 of the sheet treating apparatus based on the sheet detection signals from the sensor 183 until the count reaches the predetermined number of sheet in the bundle, and controlling the motor M142 shown in FIG. 12 by the controlling circuit 301 thereby rotating the pinion 144 shown in FIGS. 11 and 12.

For the above-described aligning operation, in order to prevent that the side edge of the sheet in movement collides with the end of the supporting surface 146*c* and is creased, the length L1 of the supporting surfaces 142*c*, 146*c* is selected larger than the offset amount L2 shown in FIG. 32. However, the length of the supporting surfaces 142*c*, 146*c* is illustrated smaller than the offset amount L2 for the purpose of brevity and clarity.

Thus aligned sheet bundle of the first copy (stapled in this state in case of the second control) is discharged as a bundle as explained before and is conveyed to the stack tray 200 as shown in FIG. 32.

Figure 36:
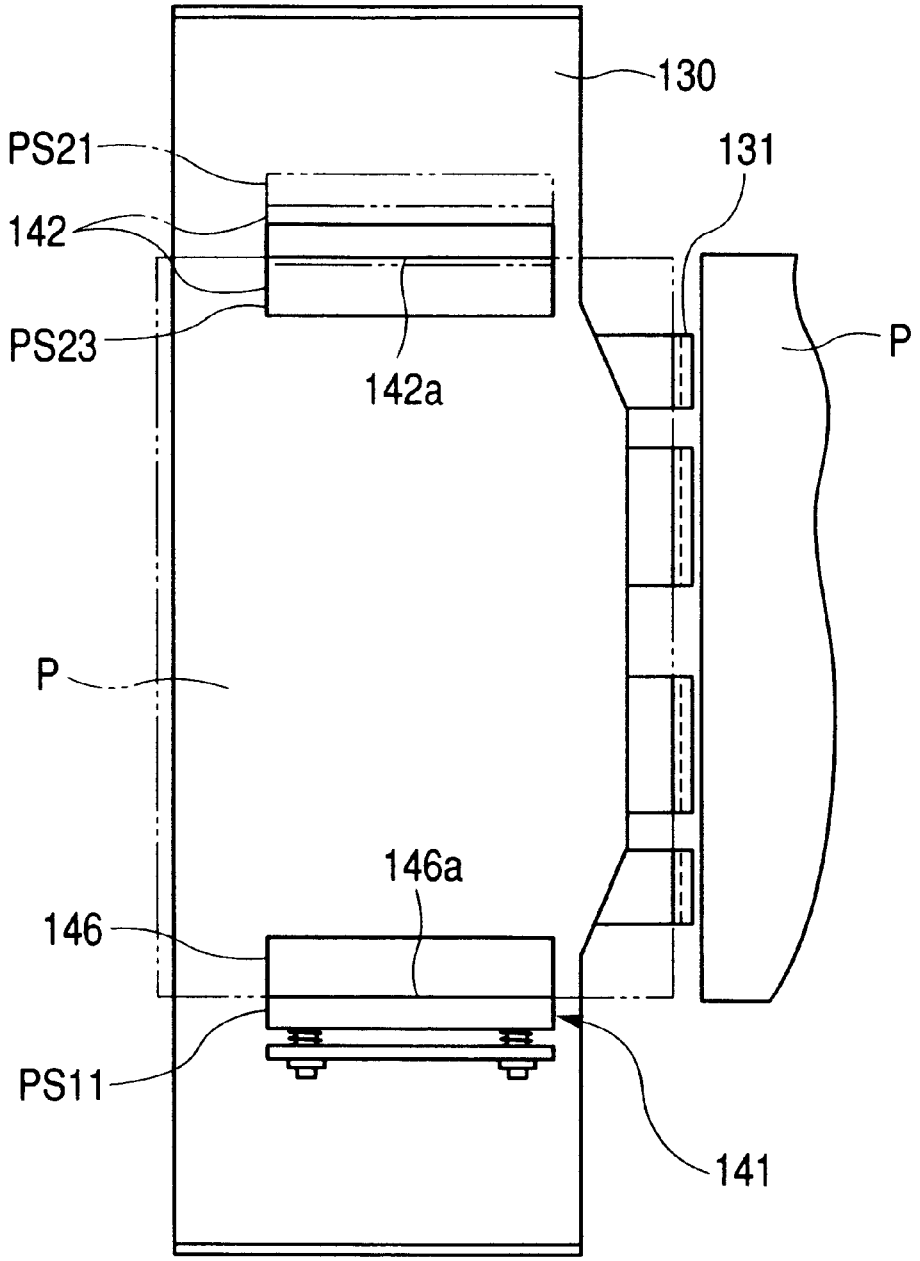

Then the sheets of the second copy are discharged onto the treating tray 130, and, in this state, the front-side aligning mechanism 141 and the rear-side aligning member 142 return to the home positions PS11, PS21 as shown in FIG. 36. When the first sheet is discharged onto the treating tray 130, the front-side aligning member 146 remains at the home position PS11 as the reference position for the second aligning position, while the rear-side aligning member 142 moves to the second aligning position PS23 shown in FIG. 36, thereby aligning the sheet. In this state, the distance between the home position PS11 and the second aligning position PS23 is somewhat wider than the sheet width.

For each sheet discharge thereafter, the rear-side aligning member 142 reciprocates between the home position PS21 and the second aligning position PS23 to align the sheets.

Thus aligned sheet bundle of the second copy (stapled in this state in case of the second control) is discharged as a bundle as explained before and is conveyed to the stack tray 200 as shown in FIG. 32 and is stacked as the second bundle from the bottom.

Figure 35:
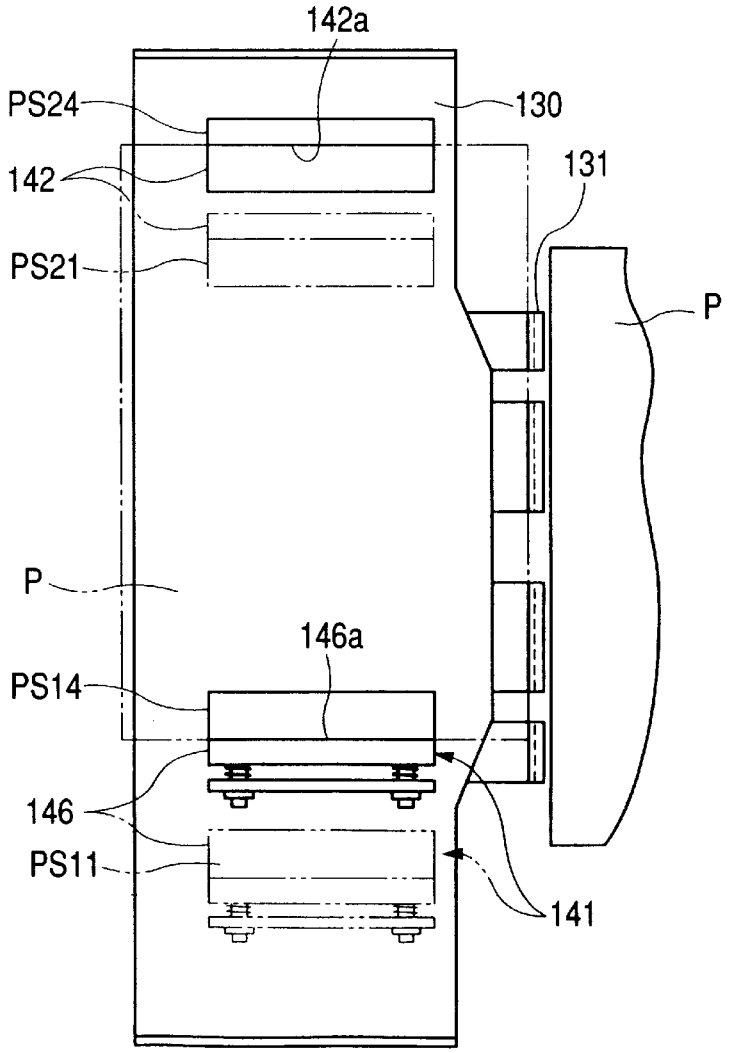
FIGS. 35 and 36 are plan views showing the sheet bundle aligning operation of the treating tray.

Subsequently the sheets of the third copy are discharged onto the treating tray 130, and, in this state, the front-side aligning mechanism 141 remains at the home position PS11 while the rear-side aligning member 142 moves to the third aligning position PS24 as shown in FIG. 35. When the sheets of the third copy is discharged onto the treating tray 130, the front-side aligning member 146 moves from the home position PS11 to the third aligning position PS14, thereby aligning the sheet in contact with the rear-side aligning member 142. In this state, the rear-side aligning member 142 remains at the third aligning position PS24, constituting the reference position for the third aligning position. In this state, the distance between the third aligning positions PS14 and PS24 is substantially the same as the sheet width.

For each sheet discharge thereafter, the front-side aligning member 141 reciprocates between the home position PS11 and the third aligning position PS14 to align the sheets.

Thus aligned sheet bundle of the third copy is stapled if desired and is discharged as a bundle as explained before. It is then conveyed to the stack tray 200 as shown in FIG. 32 and is stacked as the third bundle from the bottom.

The sheets of fourth, fifth and sixth copies are discharged to the stack tray 200 with offsets similarly to those of first, second and third copies, respectively and are stacked as shown in FIG. 32.

It is however not essential to execute offsetting for every three copies. For example, if the number of sheets in each bundle is smaller, it is possible to execute offsetting in a larger number of positions.

With such offsetting in a larger number of positions, the entire sheets become inclined to the right in FIG. 32, to bring the right-hand end of the sheets into contact with the stack tray 200, whereby the sheet bundles become arranged similar to the slates on the roof, and the entire height of the sheets can be reduced.

In the foregoing description, in the second control, the sheets are aligned in the offset position on the treating tray 130, then stapled and discharged onto the stack tray 200, but, in the first control, the controlling circuit 301 may execute control in such a manner as to align the sheets in the offset position and to stack the sheets in bundles on the stack tray 200.

The above-mentioned offset amount L2 may be varied between the sort mode and the staple mode. For example, in the staple mode, the offset amount may be so selected as to avoid mutual overlapping of the staples of the neighboring bundles after stacking (about 15 mm), and, in the sort mode, the offset amount may be so selected that the bundles can be clearly distinguished under visual observation (about 20 to 30 mm), whereby it is made possible to shorten the moving distance for alignment in the staple mode and to improve the processing speed.

In the above-mentioned second control (staple mode), the stapler 101 waits in advance in a desired clinch position with respect to the aligned sheets, and execute the stapling operation upon completion of the discharge of the last sheet of the bundle. The aligning position of the sheet bundle is changed by the offset amount for each bundle, and the stapler moves accordingly.

As already explained in the foregoing, the stapler 101 moves, with a change in the direction thereof, according to the stapling mode (diagonal stapling in the front corner, diagonal stapling in the rear corner or two-position stapling). However, in the aforementioned configuration, a same staple attitude (horizontal or inclined state) can be maintained only within a certain range, and the sheets to be stapled may have various widths, so that the stapling operation may not be achievable at a same alignment position for the stapling modes mentioned above. For this reason, the first, second and third aligning positions may be suitably varied according to the stapling mode.

Figure 39:
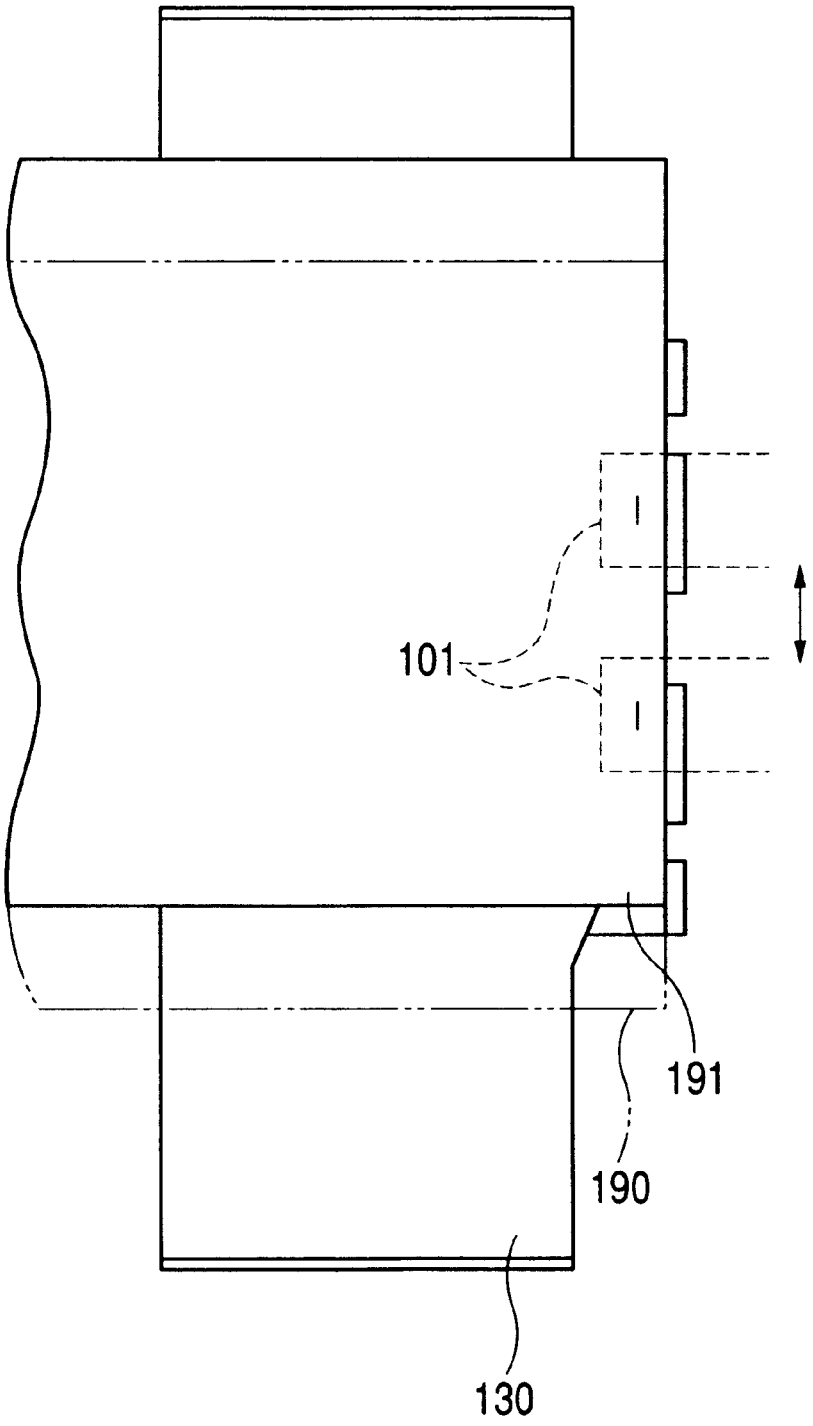
FIGS. 39, 40 and 41 are views showing sheet bundle stapling operation of the treating tray.
Figure 40:
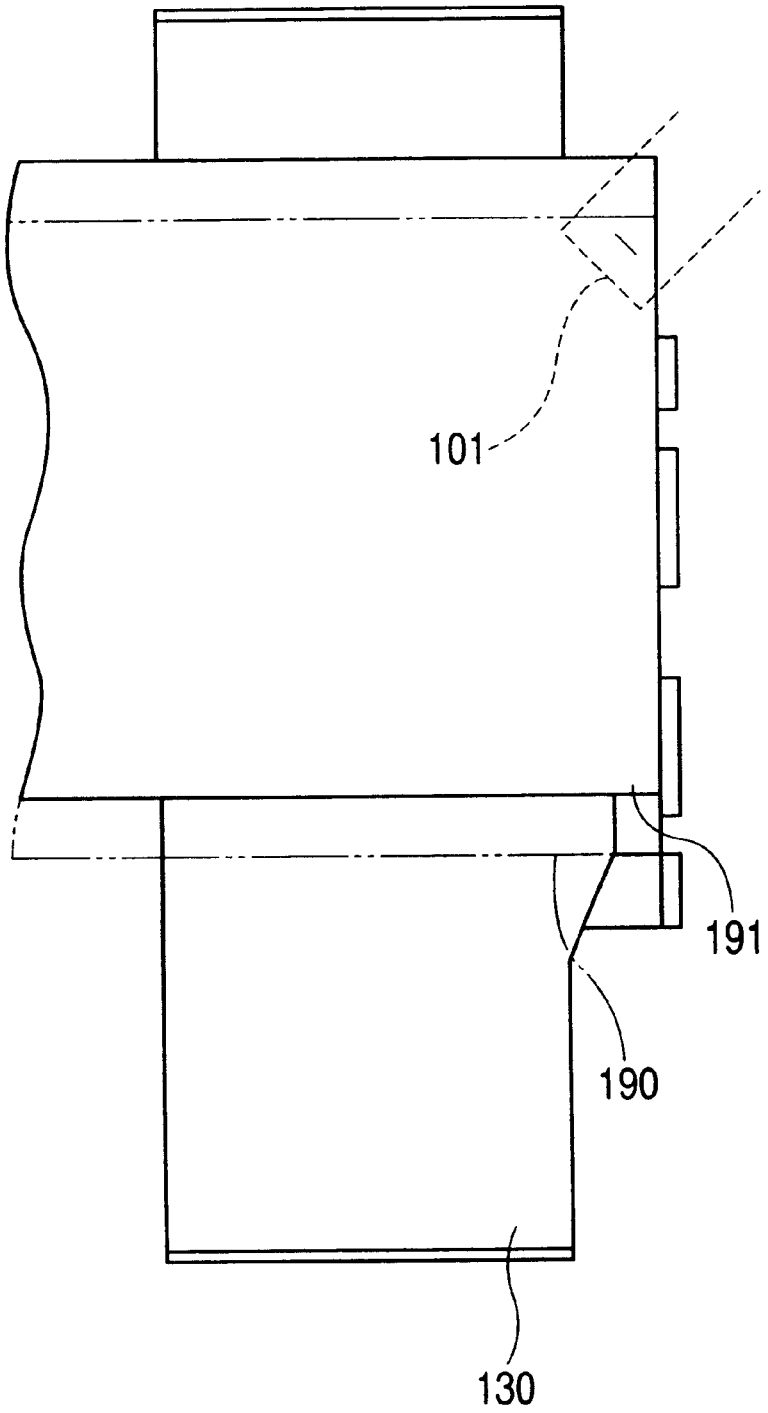
Figure 41:
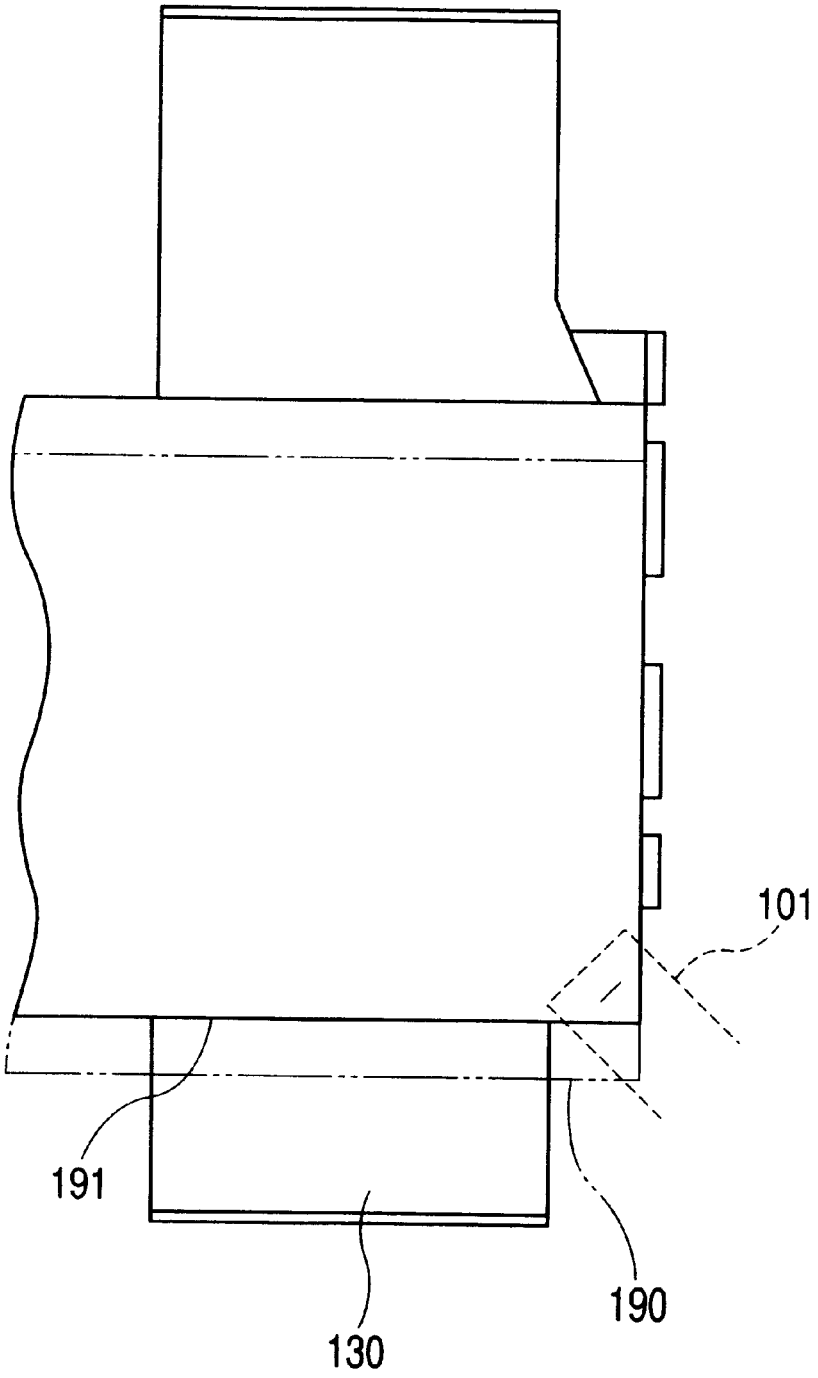

FIGS. 39, 40 and 41 show the aligning positions respectively for the two-position stapling, diagonal stapling in the rear corner and diagonal stapling in the front corner, wherein an alternate long and two short dashes line indicates the first aligning position while a solid line indicates the second aligning position. The third aligning position is not illustrated but is positioned more rear than the second aligning position.

In this operation, if the aligning position is present closer to the discharge position, the sheet is conveyed toward the front-side aligning mechanism 141 utilizing the rear-side aligning member 142 as reference, but, if the aligning position is present more rear than the discharge position, the sheet discharge is executed as explained in the foregoing.

Thus the sheet can be moved to a position corresponding to the stapler 101 by switching the aligning position according to the stapling mode.

It is thus rendered possible, in case each sheet bundle is stapled, to prevent mutual interference of the neighboring sheet bundles by offsetting, for each sheet bundle, the aligning position of the front-side aligning mechanism 141 and the aligning member 142 for aligning the bundle of the sheets discharged onto the treating tray 130 by the bundle discharge rollers 180.

The above-described aligning operation is executed in the first and second controls, and the distance between the front-side aligning member 146 and the rear-side aligning member 142 is made slightly wider than the sheet width in case of sheet alignment utilizing, as reference, the front-side aligning member 146 of the front-side aligning mechanism 141 having the spring 148 but is made substantially the same as the sheet width in case sheet alignment utilizing the rear-side aligning member 142 as reference. In the aforementioned third control, the aligning operation is executed in the same manner as in the first or second control until the number of sheets reaches a predetermined number, and beyond such number, the aligning operation is executed by selecting the distance of the front-side aligning member 146 and the rear-side aligning member 142 substantially the same as the sheet width, regardless whether the front-side aligning member 146 or the rear-side aligning member 142 is used as the reference.

More specifically, in the sheet bundle alignment in the third control corresponding to FIG. 33, when the number of sheets exceeds a predetermined number, the rear-side aligning member 142 moves to a position closer to the front-side aligning member 141 than the first aligning position PS22 in the first or second control. In this state, the distance between the front-side aligning member 146 of the front-side aligning mechanism 141 and the rear-side aligning member 142 is substantially the same as the sheet width.

Likewise, in the sheet bundle alignment corresponding to FIG. 36, when the number of sheets exceeds a predetermined number, the rear-side aligning member 142 moves to a position closer to the front-side aligning member 141 than the second aligning position PS23 in the first or second control. In this state, the distance between the front-side aligning member 146 of the front-side aligning mechanism 141 and the rear-side aligning member 142 is also substantially the same as the sheet width.

Also in case of sheet bundle alignment corresponding to FIG. 35, when the predetermined sheet number is exceeded, the front-side aligning member 146 moves to a position same as the third aligning position PS14 in the first or second control. In this state, the distance between the front-side aligning member 146 of the front-side aligning mechanism 141 and the rear-side aligning member 142 is also substantially the same as the sheet width.

In the fourth control, the sheet aligning operation is executed in the same manner as in the first or second control until the number of sheets reaches a predetermined number, and beyond the predetermined number, the aligning operation corresponding to the third control as shown in FIG. 36 is executed and the sheet bundle is stapled. More specifically, the aligning member 146 of the front-side aligning mechanism 141 is taken as the reference and the rear-side aligning member 142 comes closer to the front-side aligning member 146. Also in this case, the distance of the front-side aligning member 146 of the front-side aligning mechanism 141 and the rear-side aligning member 142 is substantially the same as the sheet width.

Figure 14:
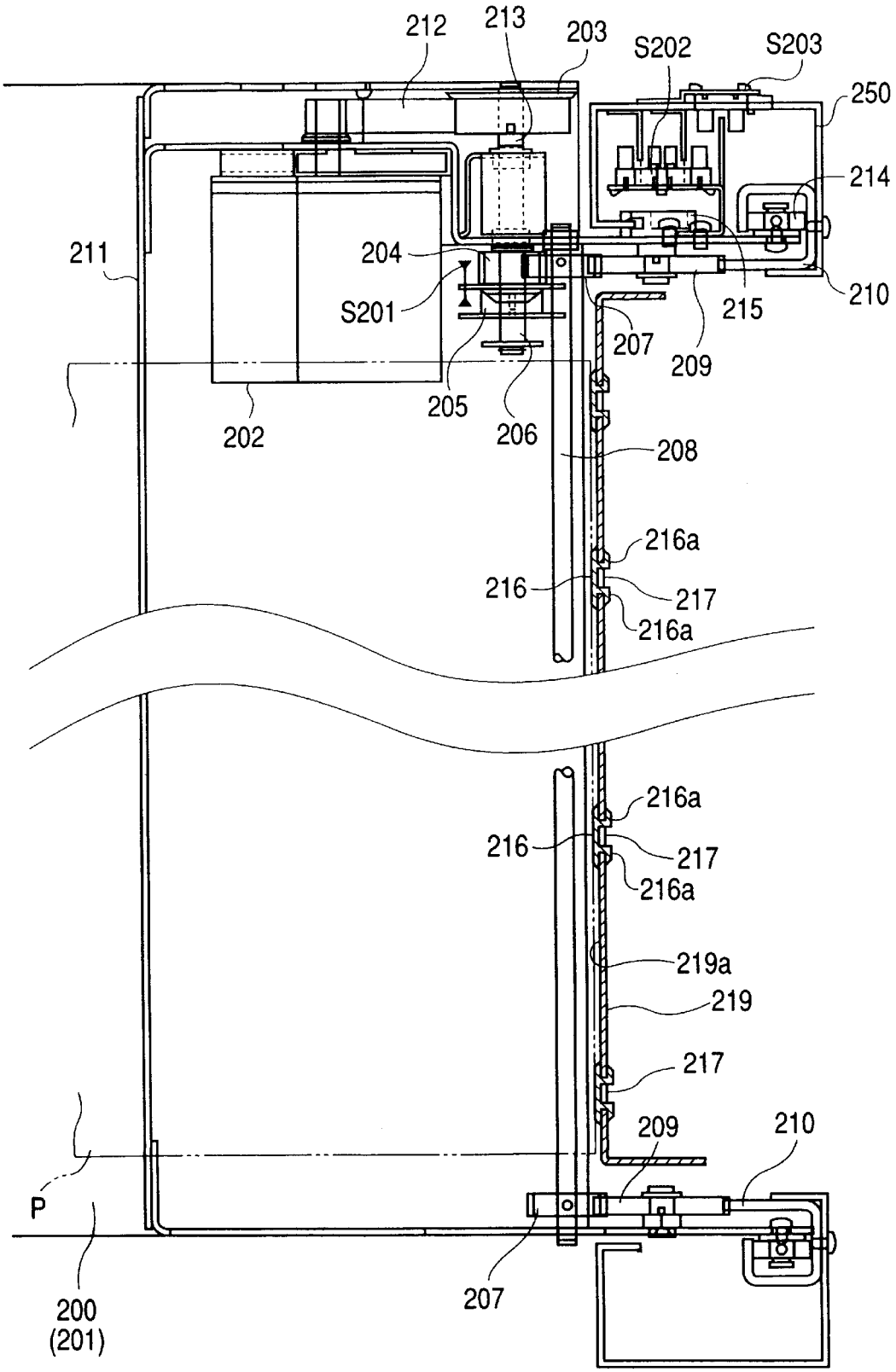
FIG. 14 is a horizontal cross-sectional view of a stacking tray moving mechanism.
Figure 15:
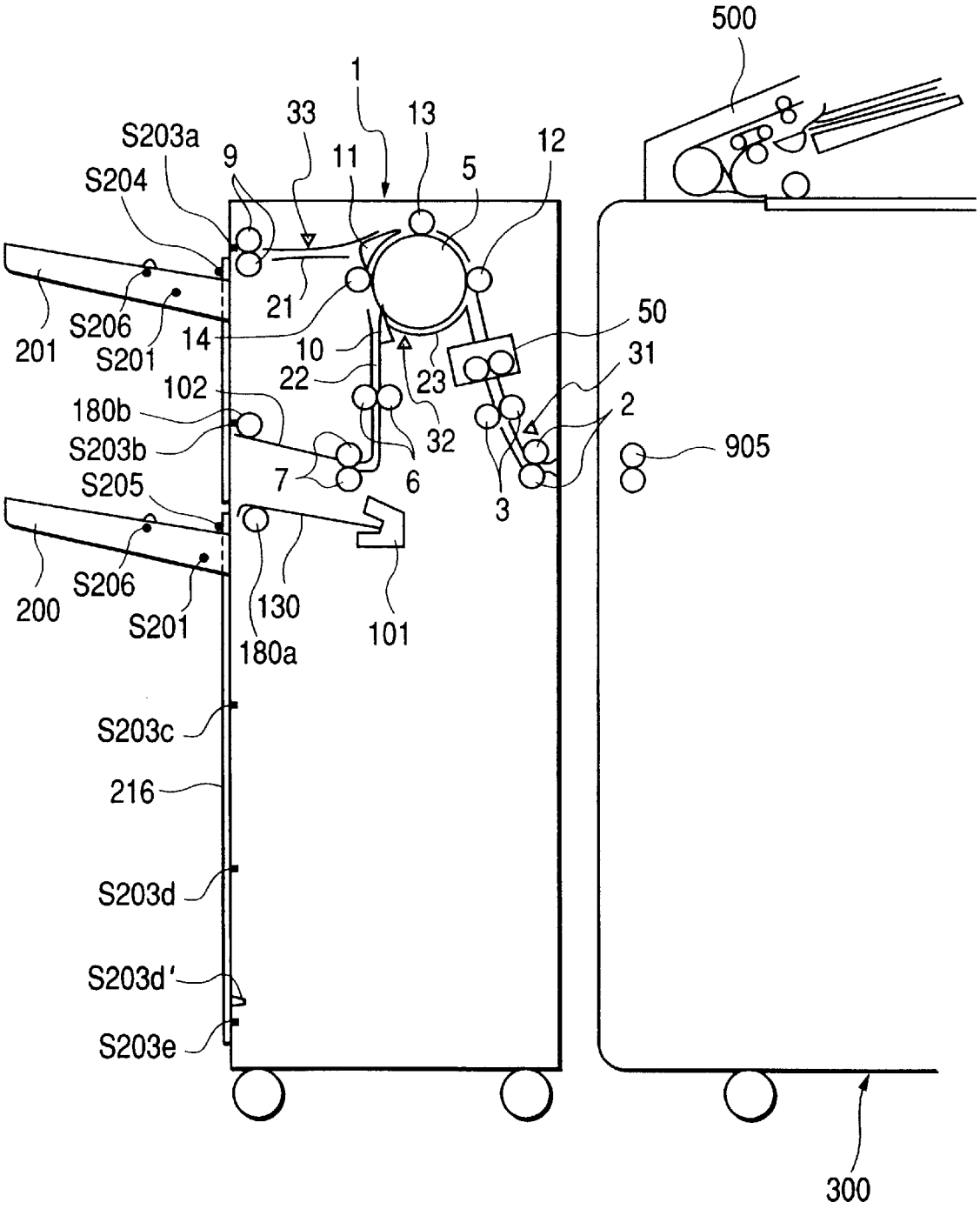
FIG. 15 is a view showing an arrangement of sensors around the stacking tray.

In the following there will be explained the movement of the stack tray 200 and the sample tray 201 (FIGS. 14 and 15).

Prior to the start of operation, these trays normally wait in the positions of respective sheet surface sensors.

As explained in the foregoing, the stack tray 200 is normally used for stacking the copied or printed sheets. It can receive the sheets treated for example by the stapler 101 or the unstapled sheet bundle discharged with a limited number of sheets, and can support up to 2000 sheets at maximum, which is detected by the sensor 203*d*.

If the printing output still continues, the stack tray 200 is lowered by a height corresponding to 1000 sheets from the position of the sensor S203*d* (namely to a position S203*d*'). Then the sample tray 201 is lowered to the position of the sheet surface sensor S205 for the treating tray, and the sheet receiving is started again. The sample tray 201 can support up to 1000 sheets at maximum, which is detected by the sensor 203*c*.

In case of starting a next job without removing the sheets on the stack tray 200 after the completion of the job not exceeding 2000 sheets or executing a job by interrupting the current job, the sample tray 201 may be used for sheet stacking from the non-sort path 21, though the treating operation is not possible.

The normal output operation to the sample tray 201 through the non-sort path 21 may be used for the output of a copy only for sample purpose without treating, or in case the output to the sample tray is selected in the function sorting.

Figure 42:
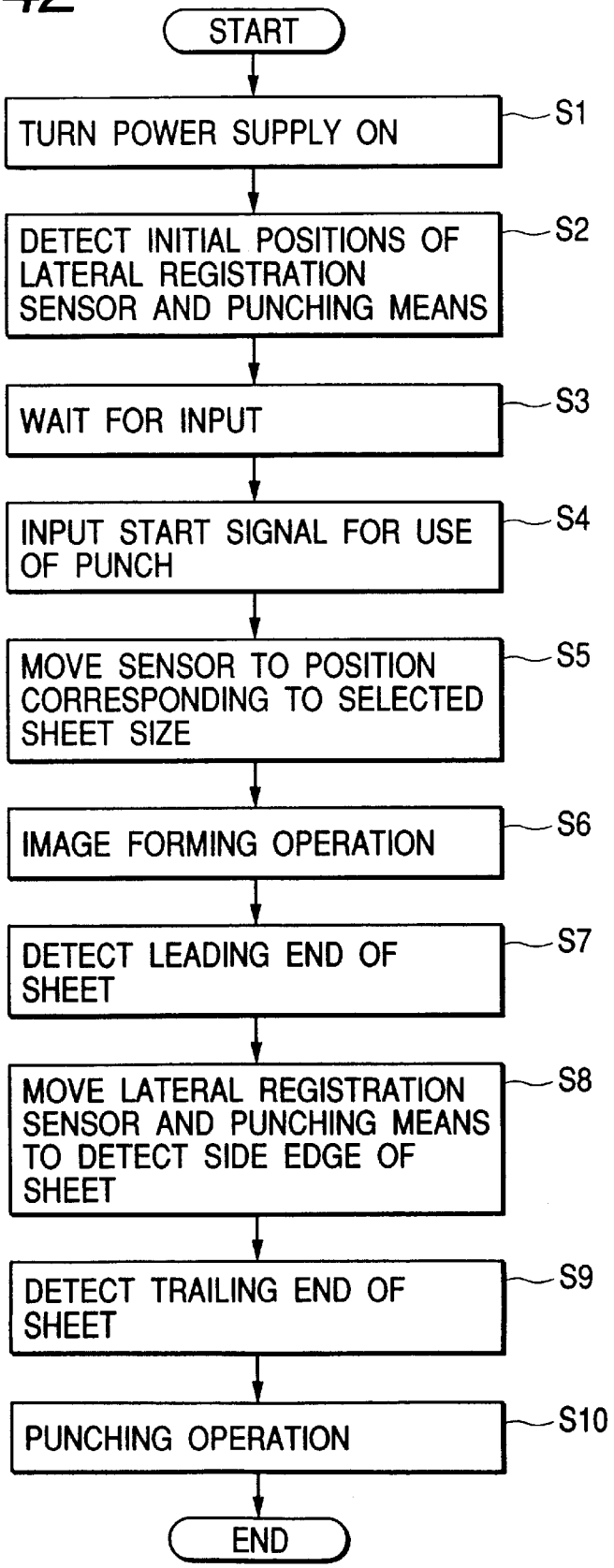
FIG. 42 is a flowchart of a punch mode.

In the following there will be explained the punch mode, principally according to a flow chart in FIG. 42, showing the operation sequence of the punch unit 50.

When the power supply of the apparatus is turned on in S1, a step S2 activates the unrepresented punching means moving motor to move the punching means 60 in the direction E (FIG. 19), whereby the light-receiving portion 71*a* of the punching means initial position sensor 71 is intercepted by the punching means initial position defining portion 52 provided in the main body 1, whereupon the initial position is detected and the movement is terminated.

Similarly the unrepresented lateral registration movement motor is activated to move the sensor arm 82 in the direction E, whereby the light-receiving portion 84*a* of the lateral registration initial position sensor 84 is intercepted by the lateral registration initial position defining portion 63*b* provided in the casing 63, whereupon the initial position is detected and the movement is terminated. There is thus reached an input waiting state (S3).

Then the user selects an unrepresented punch selection button in the main body 300 of the image forming apparatus and depressed the unrepresented start button (S4), whereby the sheet conveying and the image formation are started in the main body 300 of the image forming apparatus (S6).

At the same time, the unrepresented lateral registration movement motor is activated to move the sensor arm 82 in the direction D, thereby moving the lateral registration sensor 81 to a position corresponding to the selected sheet size (S5).

Subsequently the sheet, bearing the formed image, is conveyed into the finisher 1, and, the leading end of the sheet passes through the sheet sensor 31 and at a predetermined timing after the detection of the leading end of the sheet by the sheet sensor 31, the unrepresented punching means moving motor is activated to move the punching means 60 and the lateral registration sensor 81 in the direction D. When the light-receiving portion 81*a* of the lateral registration sensor 81 is intercepted by the side edge of the sheet, the side edge of the sheet is detected and the movement is terminated (S8).

Subsequently, the trailing end of the sheet passes through the sheet sensor 31, and upon detection of the trailing end of the sheet by the sheet sensor 31 (S9), the punch driving motor 66 is activated after a predetermined time to rotate the punch 61 and the die 62 respectively in the directions B, C, whereupon the punch 61 engages with the die hole 62*a* provided in the die 62 to punch a hole in the conveying sheet (S10). thereafter, the sheet is discharged according to any of the discharge modes described in the foregoing.

In case the number of sheets becomes relatively large (for example in excess of 40 sheets), the aligning member 142 once moves closer to the front-side aligning member 146 than the first aligning position PS22. Consequently the sheets are supported between the aligning members 146 and 142 by the elastic force of the spring 148, thus assuming an upward bent state. Subsequently the aligning member 142 moves to the first aligning position PS22, and the multiple sheets return to the flat state by the elasticity thereof, thus being securely aligned.

The aligning device 140 explained in the foregoing is provided on the treating tray 130 and serves to align the image-bearing sheets, but the aligning device 140 may also be provided on a tray which is provided in the automatic original feeder (RDF) 500 on the main body 300 of the copying machine (the main body of the image forming apparatus) as shown in FIG. 43 and which serves to receive the originals discharged after information reading.

What is claimed is:

1. A sheet treating apparatus for stacking a discharged sheet in a shape of a bundle, comprising:

sheet stacking means positioned that a downstream side of said sheet stacking means in a discharging direction is higher than an upstream side and for stacking said sheet on said sheet stacking means;

a sheet receiving member projecting from said sheet stacking means and for receiving an upstream end of said sheet on said sheet stacking means;

sheet advancing means for advancing said sheet onto said sheet stacking means;

an elastic annular sheet trailing end aligning member rotatably provided in a vicinity of said sheet advancing means and for moving said sheet stacked on said sheet stacking means toward said sheet receiving member; and a pivotally movable regulating member provided in a vertically pivotable manner in a vicinity of said sheet advancing means, said pivotally movable regulating member descending after said sheet is discharged onto said sheet stacking means and having an inclined surface for guiding, in a descended state of said pivotally movable regulating member, the upstream end of said sheet in a floating state on said sheet stacking means toward said sheet stacking means;

wherein a distal end of said inclined surface in the descended state of said pivotally movable regulating member protrudes externally from an external periphery of said sheet trailing end aligning member while a lower end of said inclined surface is positioned lower than a center of said sheet trailing end aligning member when said sheet trailing end aligning member is in a truly circular state and the lower end is in a vicinity of the external periphery of said sheet trailing end aligning member.

2. A sheet treating apparatus according to claim 1, wherein said pivotally movable regulating member pivots to an upper position not interfering with said sheet when said sheet is advanced by said sheet advancing means.

3. A sheet treating apparatus according to claim 1, wherein said pivotally movable regulating member is provided in each of plural positions in a direction crossing a sheet advancing direction and at least one of said pivotally movable regulating members is positioned outside said sheet trailing end aligning member in a transversal direction of the sheet.

4. An image forming apparatus comprising:

image forming means for forming an image on a sheet; and a sheet treating apparatus defined by claim 1 or 3.

* * * * *

UNITED STATES PATENT AND TRADEMARK OFFICE

CERTIFICATE OF CORRECTION

PATENT NO. : 6,283,470 B1
DATED : September 4, 2001
INVENTOR(S) : Katsuaki Hirai It is certified that error appears in the above-identified patent and that said Letters Patent is hereby corrected as shown below:

Column 1,
Line 62, "sheet" should read -- sheets --.

Column 2,
Line 20, "The-sheet" should read -- The sheet --.

Column 7,
Line 11, "a extension" should read -- an extension --.
Line 66, "member" should read -- members --.
Line 67, "belt" should read -- belts --.

Column 10,
Line 35, "1800" should read -- 180° --.
Line 44, "a which" should read -- which --.

Column 15,
Line 17, "discharge" should read -- discharged --.
Line 65, "depressed" should read -- depresses --.

Column 16,
Line 35, "details." should read -- detail. --.
Line 57, "following" should read -- the following --.

Column 17,
Line 39, "wait" should read -- waits --.
Line 67, "sheet" (2nd occurrence) should read -- sheets --.

Column 18,
Line 18, "sheet" should read -- sheets --.
Line 30, "Thus" should read -- The thus --.
Line 31, "case" should read -- the case --.
Line 59, "is" should read -- are --.

UNITED STATES PATENT AND TRADEMARK OFFICE

CERTIFICATE OF CORRECTION

PATENT NO. : 6,283,470 B1
DATED : September 4, 2001
INVENTOR(S) : Katsuaki Hirai It is certified that error appears in the above-identified patent and that said Letters Patent is hereby corrected as shown below:

Column 19,
Line 4, "Thus" should read -- The thus --.
Line 41, "execute" should read -- executes --.

Column 20,
Line 19, "case" should read -- the case --.
Line 22, "case" should read -- the case --.

Column 21,
Line 24, "case" should read -- the case --.
Line 56, "depressed" should read -- depresses --.

Signed and Sealed this

Ninth Day of April, 2002

*Attest:*

*Attesting Officer*

JAMES E. ROGAN
*Director of the United States Patent and Trademark Office*